US006268104B1

(12) United States Patent
Yumoto et al.

(10) Patent No.: US 6,268,104 B1
(45) **Date of Patent: *Jul. 31, 2001**

(54) HEAT-SENSITIVE RECORDING MATERIAL COMPRISING A URACIL COUPLING COMPONENT

(75) Inventors: Masatoshi Yumoto; Kimi Ikeda; Hiroshi Yamamoto, all of Shizuoka-ken (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/438,056

(22) Filed: Nov. 10, 1999

(30) Foreign Application Priority Data

Nov. 20, 1998 (JP) ..... 10-331771

(51) Int. Cl.[7] ..... G03C 1/72; G03C 1/58

(52) U.S. Cl. ..... 430/138; 430/157; 430/163; 430/171; 430/182; 430/187

(58) Field of Search ..... 430/138, 157, 430/171, 182, 187, 163

(56) References Cited

U.S. PATENT DOCUMENTS 6,017,672 * 1/2000 Arai et al. ..... 430/138

FOREIGN PATENT DOCUMENTS

| | | | |
|---|---|---|---|
| 0 323 887 | 7/1989 | (EP) | G03C/1/52 |
| 2 181 564 | 4/1987 | (GB) | B41M/5/12 |
| 8-244342 | 9/1996 | (JP) | B41M/5/26 |
| 9-315006 | 9/1997 | (JP) | B41M/5/30 |

* cited by examiner

*Primary Examiner*—John S. Chu

(74) *Attorney, Agent, or Firm*—Sughrue, Mion, Zinn, Macpeak & Seas, PLLC

(57) ABSTRACT

A heat-sensitive recording material comprising a support and a heat-sensitive recording layer thereon, which contains a diazonium salt compound and a coupling component, is provided. The diazonium salt compound contains a benzenediazonium salt compound represented by formula (1) and the coupling component contains a uracil compound represented by formula (2) or a barbituric acid compound represented by formula (3).

Formula (1)

Formula (2)

Formula (3)

20 Claims, No Drawings

HEAT-SENSITIVE RECORDING MATERIAL COMPRISING A URACIL COUPLING COMPONENT

BACKGROUND OF THE INVENTION

1. Field of the Invention

The present invention relates to a heat-sensitive recording material using a combination of a diazonium salt compound and a coupling component as color developing components and, particularly, to a heat-sensitive recording material which is stable with respect to light having longer wavelengths of from about 350 nm of a light source such as a fluorescent lamp, or the like, and which exhibits excellent storability before use, excellent density of color formation when heat-developed, and superior light fastness of heat-recorded images.

2. Description of the Related Art

A diazonium salt compound is a compound having a very high chemical activity, and reacts with a compound called a "coupling component", such as a phenol derivative or a compound containing an active methylene group, to easily form an azo dye. Also, diazonium salt compounds are photosensitive and are decomposed by the irradiation of light, thereby losing their chemical activity. For these reasons, diazonium salt compounds have been utilized for a long time as photo-sensitive recording materials such as diazo copies (see *Fundamentals of Photographic Engineering, Non-Silver Salt Photography Edition, edited* by The Japan Photographic Association, published by Corona Co., Ltd., pp. 89–117 and pp. 182–201(1982)).

Furthermore, diazonium salt compounds have recently been applied to recording materials of which image fixing is required by utilizing the property of diazonium salt compounds losing their activity by being decomposed by light. As a typical example, a so-called photo-fixing type heat-sensitive recording material has been proposed wherein, after images are formed by the heating and reacting of a recording material provided with a recording layer containing a diazonium salt compound and a coupling component according to image signals, the images are fixed by the irradiation of light (see Kohji Sato, et al., *Journal of The Image Electronics Society*, Vol. 11, No. 4, pp. 290–296 (1982), etc.).

However, such recording materials using a diazonium salt compound as a color forming component have the drawback that the shelf-life thereof as a recording material is short because the chemical activity of the diazonium salt compound is very high and the diazonium salt compound gradually heat-decomposes even in the dark, thereby losing its reactivity.

As means for improving stability of a diazonium salt compound, various methods have been proposed, and as one of the most effective means, there is a method of encapsulating the diazonium salt compound in microcapsules. By microencapsulating the diazonium salt compound, the diazonium salt compound is isolated from materials which accelerate the decomposition thereof, such as water and bases. Therefore, the decomposition of the diazonium salt compound is markedly suppressed, and the shelf-life of a recording material using the microcapsules is greatly improved (see Toshimasa Usami, et al., *Journal of The Society of Electrophotography of Japan*, Vol. 26, No. 2, pp. 115–125 (1987)).

A general method of encapsulating a diazonium salt compound in microcapsules is carried out as follows. The diazonium salt compound is dissolved in a hydrophobic solvent to obtain a solution (an oil phase), the solution is added into an aqueous solution of a water-soluble polymer (an aqueous phase). The mixture is emulsified by a homogenizer or the like. Due to the addition of a monomer or prepolymer serving as a wall material of the microcapsules into either one of or both of the oil phase and the aqueous phase, a polymerization reaction is conducted at the interface between the oil phase and the aqueous phase. Alternatively, a method of forming microcapsules, in which walls of a polymer compound are formed by depositing a polymer, can be carried out.

These methods are described in detail, for example, in Asato Kondo, "*Microcapsules*", published by Nikkan Kogyo Shinbun-sha, 1970, and Tamotsu Kondo, et al., "*Microcapsules*", published by Sankyo Shuppan, 1977.

For the walls of the microcapsules, various materials can be used such as crosslinked gelatin, algintates, celluloses, urea resins, urethane resins, melamine resins, nylon resins and the like.

In a case in which microcapsules have walls formed of a material such as a urea resin or a urethane resin having a glass transition temperature and the glass transition temperature is slightly higher than room temperature, the walls of microcapsules exhibit material impermeability at room temperature, but exhibit a material permeability at the glass transition temperature or higher. Such microcapsules are called "thermally responsive microcapsules" and are useful in heat-sensitive recording materials.

Namely, with a heat-sensitive recording material in which a heat-sensitive recording layer, which contains (a) thermally responsive microcapsules containing a diazonium salt compound, (b) a coupling component and (c) a base, is provided on a support, the diazonium salt compound can be kept stable for a long period of time and also color images can be easily formed by heating. Moreover, the images can also be fixed by light irradiation.

As mentioned above, by encapsulating a diazonium salt compound, the stability of the heat-sensitive recording material can be improved significantly.

However, when the diazonium salt compound itself is chemically unstable, even if the diazonium salt compound is encapsulated, there is a limit to the improvement in stability of the heat-sensitive recording material. To improve the stability of a heat-sensitive material, it is also important to improve the stability of the diazonium salt compound itself. In a conventional heat-sensitive recording material using a diazonium salt compound, after thermally printing, so-called fixing is carried out in which the recording material thus printed is irradiated with light having the absorption wavelength of the diazonium salt compound, whereby the diazonium salt compound is photodecomposed to lose its reactivity with the coupling component. Accordingly, when the heat-sensitive recording material is left for a long period of time in a light place, the photodecomposition of the diazonium salt compound proceeds. This results in the problem that the density of color formation after storing is liable to deteriorate and the like. In particular, in the case of preparing a multicolor heat-sensitive recording material formed by laminating plural heat-sensitive recording layers each containing a diazonium salt compound having a different developed color hue, there is a problem that when the diazonium salt compound in the upper layer is photo-fixed, the uncolored diazonium salt compounds existing in the lower layers are photodecomposed.

SUMMARY OF THE INVENTION

Accordingly, an object of the present invention is to provide a heat-sensitive recording material, which is stable with respect to light having wavelengths longer than about 350 nm, has excellent stability before use, excellent density of color formation when heat-developed, and superior light fastness of heat-recorded images.

As the result of investigations into the photodecomposing property of diazonium salt compounds, the present inventors have discovered that the diazonium salt compound, represented by following formula (1), is stable with respect to light of wavelengths longer than about 350 nm, which are wavelengths of light sources such as fluorescent lamps and the like, and that when this diazonium salt compound is combined with a particular coupling component, excellent storability before use and excellent density of color formation and light fastness of images after heat recording are obtained. That is to say, the present inventors have discovered the following <1>~<3>.

<1> A heat-sensitive recording material in which a heat-sensitive recording layer containing a diazonium salt compound and a coupling component is provided on a support, wherein the diazonium salt compound contains a benzenediazonium salt compound represented by following formula (1) and the coupling component contains a uracil compound represented by following formula (2), Formula (1)

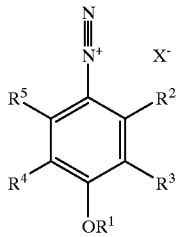

wherein $R^1$ represents an alkyl group or an aryl group; $R^2$, $R^3$, $R^4$, and $R^5$ each independently represents a hydrogen atom or an alkyl group, and at least one of $R^2$, $R^3$, $R^4$, and $R^5$ represents an alkyl group; $X^-$ represents an anion; and $R^1$ and $R^3$, or $R^1$ and $R^4$, or $R^2$ and $R^3$, or $R^4$ and $R^5$ may bind to form a ring.

Formula (2)

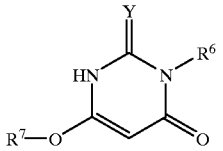

wherein $R^6$ represents a hydrogen atom, an alkyl group, an aryl group, an acyl group, an alkylsulfonyl group, or an arylsulfonyl group; $R^7$ represents an alkyl group, an aryl group, an alkenyl group, or an alkinyl group; and Y represents an oxygen atom or a sulphur atom.

<2> A heat-sensitive recording material in which a heat-sensitive recording layer containing a diazonium salt compound and a coupling component is provided on a support, wherein the diazonium salt compound contains the benzenediazonium salt compound represented by formula (1) and the coupling component contains a barbituric acid compound represented by following formula (3), Formula (3)

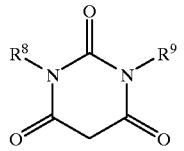

wherein $R^8$ and $R^9$ each independently represents a hydrogen atom, an alkyl group, an aryl group, an acyl group, an alkylsulfonyl group or an arylsulfonyl group.

<3> A heat-sensitive recording material according to <1> or <2> wherein the diazonium salt compound is encapsulated in microcapsules.

DESCRIPTION OF THE PREFERRED EMBODIMENTS

In accordance with the heat-sensitive recording material of the present invention in which a heat-sensitive recording layer containing a diazonium salt compound and a coupling component is provided on a support, the diazonium salt compound contains the benzenediazonium salt compound represented by formula (1) and the coupling component contains the uracil compound represented by formula (2) or the barbituric acid compound represented by formula (3).

A description will be given hereinafter of the benzenediazonium salt compound which is a diazonium salt compound and is represented by formula (1).

In formula (1), $R^1$ represents an alkyl group or an aryl group.

As the alkyl group representing $R^1$, an alkyl group having from 1 to 30 carbon atoms is preferable, and examples of the alkyl group include methyl, ethyl, propyl, butyl hexyl, 2-ethylhexyl, octyl, decyl, dodecyl, benzyl, allyl, 2-chloroethyl, 2-methoxyethyl, 2-phenoxyethyl, 2-(4-methoxyphenoxy)ethyl, 2-cyanoethyl, ethoxycarbonylmethyl, 2-ethoxycarbonylethyl, N,N-dibutylcarbamoylmethyl and the like.

The alkyl group which represents $R^1$ may be substituted by substituents. Examples of preferable substituents include a halogen atom, an aryl group, an alkenyl group, an alkoxy group, an aryloxy group, an alkoxycarbonyl group, an acyloxy group, an acylamino group, a carbamoyl group, a cyano group, an alkylsulfenyl group, an arylsulfenyl group, an alkylsulfinyl group, an arylsulfinyl group, an alkylsulfonyl group, an arylsulfonyl group, a sulfonamido group, a sulfamoyl group, a carboxy group, a sulfonic acid group, an acyl group, and a heterocyclic group. Among these substituents, a halogen atom, an aryl group, an alkenyl group, an alkoxy group, an aryloxy group, an alkoxycarbonyl group, an acylamino group, a carbamoyl group, and a cyano group are particularly preferable.

As the aryl group which represents $R^1$, an aryl group having from 6 to 30 carbon atoms is preferable, and examples thereof include phenyl, 4-methoxyphenyl, and 4-chlorophenyl.

The aryl group which represents $R^1$ may be substituted by substituents. Examples of preferable substituents include a halogen atom, an aryl group, an alkenyl group, an alkoxy group, an aryloxy group, an alkoxycarbonyl group, an acyloxy group, an acylamino group, a carbamoyl group, a cyano group, an alkylsulfenyl group, an arylsulfenyl group, an alkylsulfinyl group, an arylsulfinyl group, an alkylsulfonyl group, an arylsulfonyl group, a sulfonamido group, a sulfamoyl group, a carboxy group, a sulfonic acid group, an acyl group, and a heterocyclic group. Among these substituents, a halogen atom, an aryl group, an alkoxy group, an alkoxycarbonyl group, an acylamino group, and a carbamoyl group, are particularly preferable.

In formula (1), $R^2$, $R^3$, $R^4$, and $R^5$ each independently represents a hydrogen atom or an alkyl group, and at least one of $R^2$, $R^3$, $R^4$, and $R^5$represents an alkyl group.

As the alkyl group which represents $R^2$, $R^3$, $R^4$ and $R^5$, an alkyl group having from 1 to 30 carbon atoms is preferable, and examples of the alkyl group include methyl, ethyl, propyl, butyl, hexyl, 2-ethylhexyl, octyl, decyl, dodecyl, benzyl, allyl, phenylsulfonylmethyl, cyanomethyl and the like. Among these groups, methyl, ethyl, propyl, and allyl are particularly preferable.

The alkyl group which represents $R^2$, $R^3$, $R^4$, and $R^5$ may be substituted by substituents. Examples of preferable substituents include a halogen atom, an aryl group, an alkenyl group, an alkoxy group, an aryloxy group, an alkoxycarbonyl group, an acyloxy group, an acylamino group, a carbamoyl group, a cyano group, an alkylsulfenyl group, an arylsulfenyl group, an alkylsulfinyl group, an arylsulfinyl group, an alkylsulfonyl group, an arylsulfonyl group, a sulfonamido group, a sulfamoyl group, a carboxy group, a sulfonic acid group, an acyl group, and a heterocyclic group. Among these substituents, an aryl group, an alkenyl group, an alkoxy group, an aryloxy group, an acyloxy group, a cyano group, an alkylsulfonyl group, and an arylsulfonyl group are particularly preferable.

In formula (1), $R^1$ and $R^3$, or $R^1$ and $R^4$, or $R^2$ and $R^3$, or $R^4$ and $R^5$ may bind to form a ring, preferably a 5- or 6-membered ring.

In formula (1), $X^-$ represents an anion.

The anion represented by $X^-$ may be an inorganic anion or an organic anion. As the inorganic anion, a hexafluorophosphate ion, a borofluoride ion, a chloride ion, and a sulfate ion are preferable, and a hexafluorophosphate ion is particularly preferable. As the organic anion, a polyfluoroalkylcarboxylate ion, a polyfluoroalkylsulfonate ion, a tetraphenylborate ion, an aromatic carboxylate ion, and an aromatic sulfonate ion are preferable.

As the benzenediazonium salt compound represented by formula (1), a benzenediazonium salt compound represented by following formula (4) in which $R^3$ and $R^4$ represent a hydrogen atom, is preferable with regard to thermostability.

Formula (4)

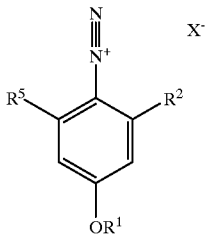

wherein $R^1$, $R^2$, $R^5$, and $X^-$ are the same as $R^1$, $R^2$, $R^5$ and $X^-$ in the formula (1), respectively. However, in formula (4), at least one of $R^2$ and $R^5$ represents an alkyl group.

Specific examples of the benzenediazonium salt compound represented by formula (1) include, but are not limited to, the following Compounds (1-1) to (9-1).

1-1

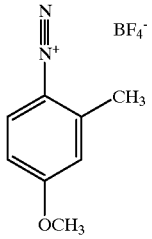

1-2

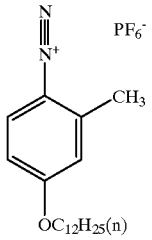

1-3

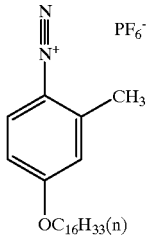

1-4

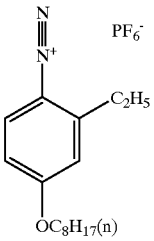

1-5

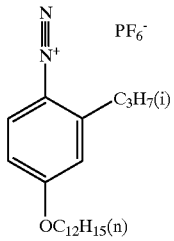

1-6

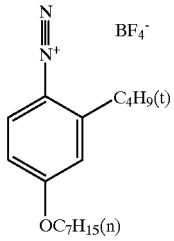

-continued
1-7
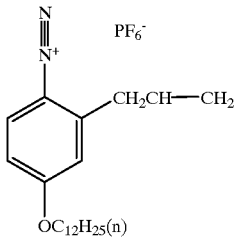
1-8
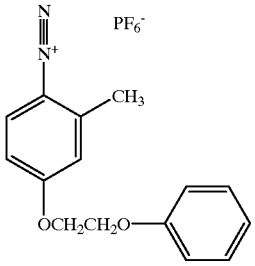
1-9
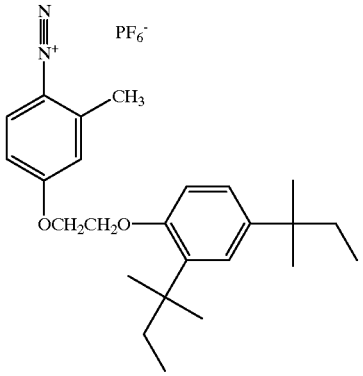
1-10
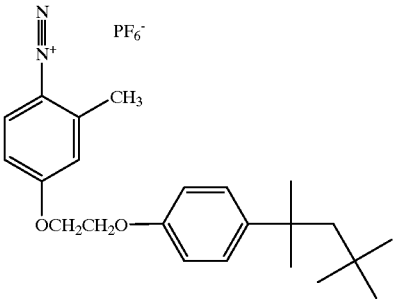
1-11
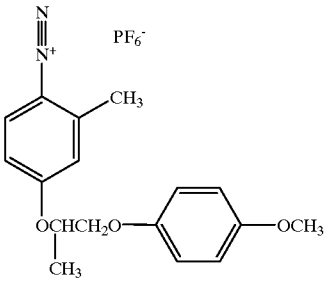
-continued
1-12
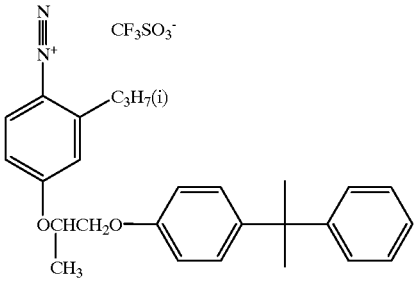
1-13
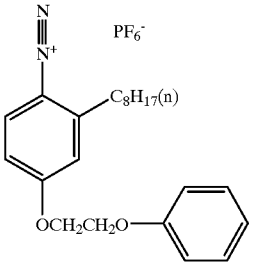
1-14
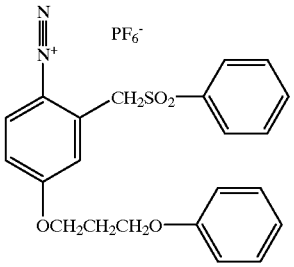
1-15
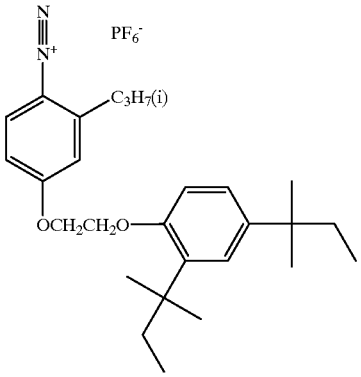
1-16
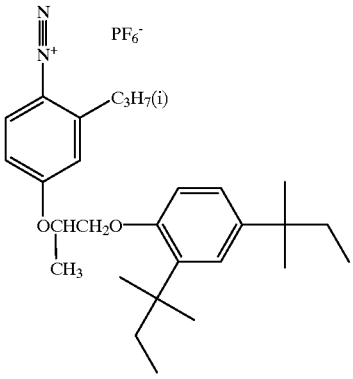

-continued
1-17
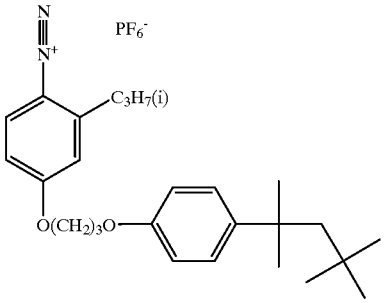
1-18
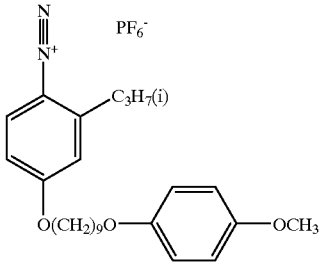
1-19
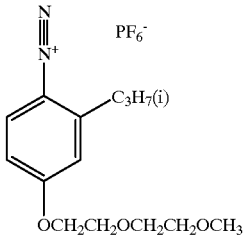
2-1
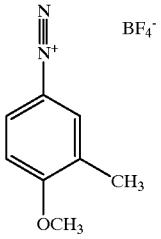
2-2
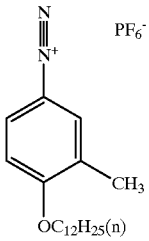
2-3
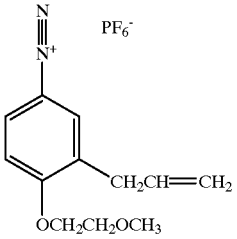
-continued
2-4
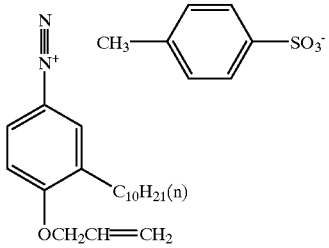
2-5
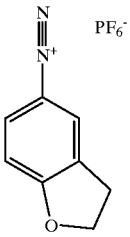
3-1
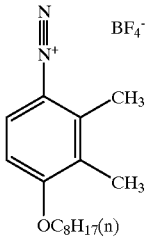
3-2
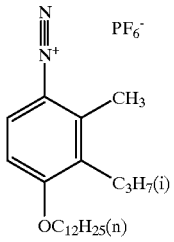
3-3
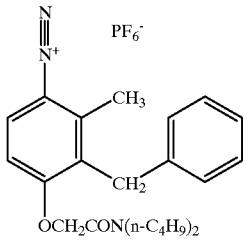
3-4
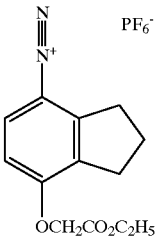

-continued
4-1
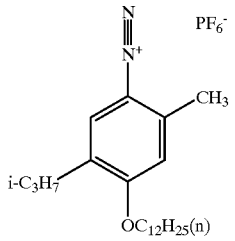
4-2
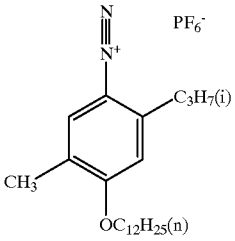
4-3
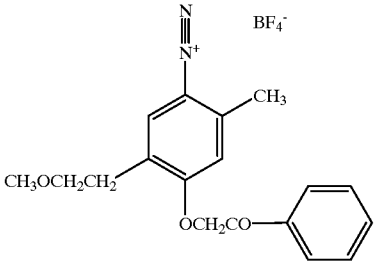
4-4
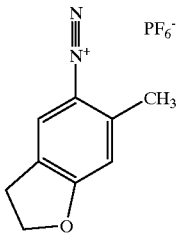
5-1
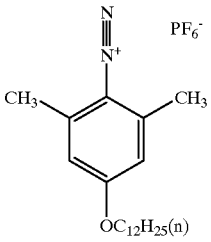
-continued
5-2
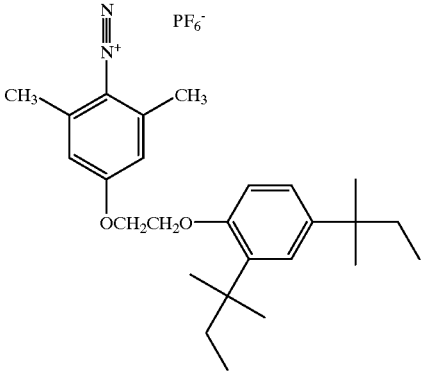
5-3
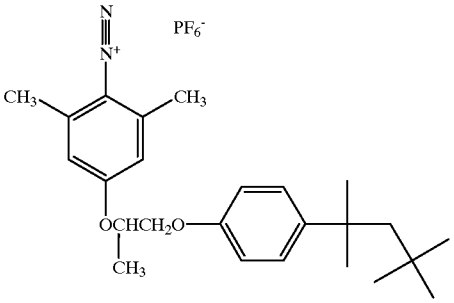
5-4
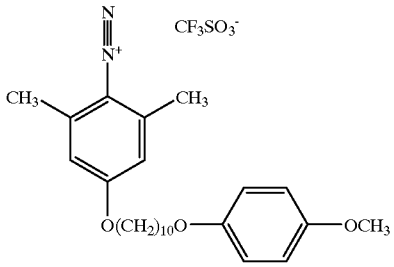
5-5
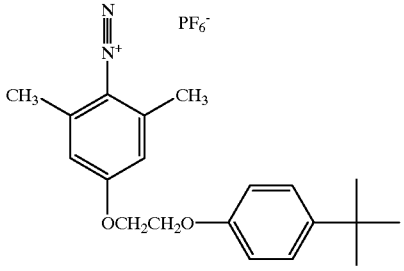
5-6
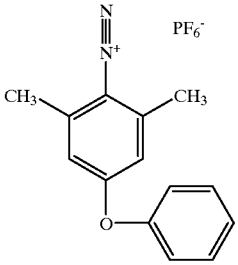

-continued 5-7

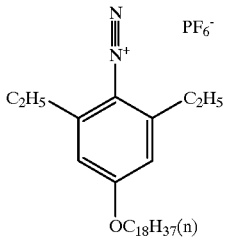

5-8

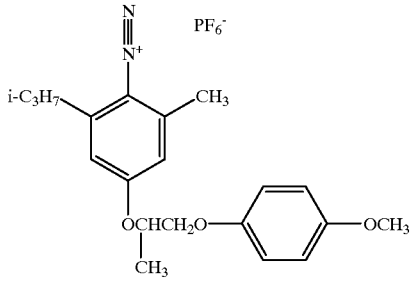

6-1

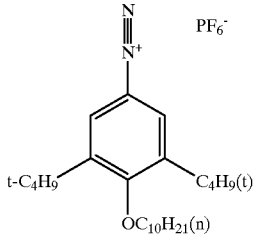

6-2

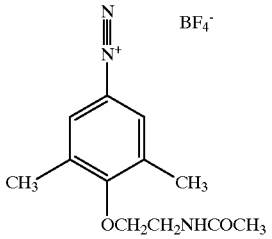

6-3

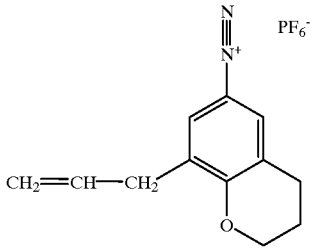

7-1

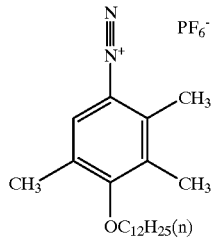

-continued 7-2

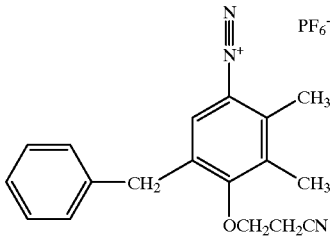

8-1

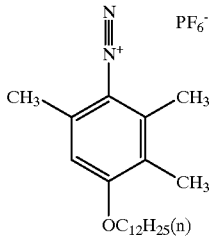

8-2

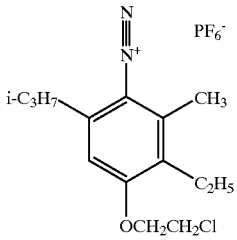

9-1

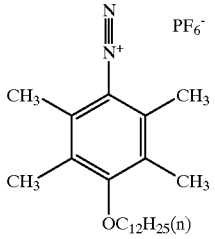

The diazonium salt compound represented by the formula (1) can be produced by known methods. That is, the diazonium salt compound may be obtained by diazotizing a corresponding aniline in an acidic solvent by using sodium nitrite, nitrosylsulfuric acid, isoamyl nitrite, or the like. As an example, a synthesis example of the Compound (1-2) is described hereinafter. (Synthesis Example 1) Synthesis of Compound (1-2)

A mixture of 25.2 g of 2-methyl-4-dodecyloxyaniline, 21.8 ml of concentrated hydrochloric acid, and 100 ml of methanol was cooled to −5° C. To the mixture was added dropwise a solution of 6.2 g of sodium nitrite dissolved in 30 ml of water, and the resultant mixture was stirred for 30 minutes at 0° C. To the reaction mixture were added 19.2 g of potassium hexafluorophosphate and 200 ml of water, and the mixture was stirred for 30 minutes at 10° C. The precipitated cystals were collected by filtration, recrystallized from isopropanol, and dried to obtain 23.7g of Compound 1-2. The maximum absorption wavelength λmax of the ultraviolet absorption spectrum in methanol of this compound was 316 nm, and the molecular absorbancy coefficient ϵ thereof was $2.48\times10^4$.

The benzenediazonium salt compound represented by formula (1) may be an oily material or in a crystal state, but a crystal state at room temperature is preferable with respect to handling properties. In the case of making the benzenediazonium salt compound represented by formula (1) an emulsion, the benzene diazonium salt compound may be dissolved in an appropriate high-boiling point solvent (e.g., tricresyl phosphate or dioctyl phthalate), or may be auxiliarily dissolved in a low-boiling point solvent (e.g., ethyl acetate). Therefore, it is preferable that the benzenediazonium salt compound is suitably soluble in these solvents. Specifically, it is preferable that the benzenediazonium salt compound has a solubility of at least 5% in the above solvents, and it is also preferable that the solubility thereof in water is 1% or less.

The benzenediazonium salt compounds represented by formula (1) may be used singly or as a combination of two or more kinds.

The preferable content of the benzenediazonium salt compound is from 0.02 to 5 $g/m^2$ in the heat-sensitive recording layer, and from the standpoint of the density of color formation, it is particularly preferable for an amount in the range of from 0.1 to 4 $g/m^2$ to be contained in the heat-sensitive recording layer.

The benzenediazonium salt compound represented by formula (1) may be used as a complex in order to stabilize the benzenediazonium salt compound. Examples of compounds which form the complex of the benzenediazonium salt compound include zinc chloride, cadmium chloride, tin chloride, and the like.

Together with the benzenediazonium salt compound represented by formula (1), other diazonium salt compounds can be optionally used in order to adjust the hue of the color-developed image after heat-recording. It is preferable that 50% by weight or more of the entire amount of diazonium salt compounds to be used is the benzenediazonium salt compound represented by formula (1).

Other diazonium salt compounds usable with the benzenediazonium salt compound include 2,4-dioctyloxybenzenediazonium hexafluorophosphate, 2-benzyloxy-4-hexyloxybenzenediazonium hexafluorophosphate, and the like.

A detailed description will be given of the uracil compound represented by above formula (2) which is the coupling component used in combination with the benzenediazonium salt compound represented by formula (1).

In formula (2), $R^6$ represents a hydrogen atom, an alkyl group, an aryl group, an acyl group, an alkylsulfonyl group, or an arylsulfonyl group. As $R^6$, an alkyl group or an aryl group is preferable.

As the alkyl group represented by $R^6$, an alkyl group having from 1 to 28 carbon atoms is preferable, and examples thereof include a methyl group, an ethyl group, a butyl group, a cyclohexyl group, an octyl group, an octadecyl group and the like.

The alkyl group represented by $R^6$ may be substituted by substituents. Examples of these substituents include a halogen atom, an alkoxycarbonyl group, an N-substituted carbamoyl group, an aryl group, an alkoxy group, an aryloxy group, and the like.

As the aryl group represented by $R^6$, an aryl group having from 5 to 36 carbon atoms is preferable, and examples thereof include a phenyl group, a pyridyl group, a naphthyl group, and the like.

The aryl group represented by $R^6$ may be substituted by substituents. Examples of these substituents include an alkyl group, an aryl group, an alkoxy group, an aryloxy group, an alkylthio group, an arylthio group, a dialkylamino group, an acyl group, an alkoxycarbonyl group, an acyloxy group, a carbamoyl group, an N-substituted carbamoyl group, a sulfamoyl group, an N-substituted sulfamoyl group, a sulfonylamino group, an alkylsulfonyl group, an arylsulfonyl group, an acylamino group, a halogen atom, a cyano group, a trifluoromethyl group, and the like.

As the acyl group represented by $R^6$, an acyl group having from 2 to 30 carbon atoms is preferable, and examples thereof include an acetyl group, a pivaloyl group, a benzoyl group and the like.

The acyl group represented by $R^6$ may be substituted by substituents. Examples of substituents include an alkyl group, an aryl group, an alkoxy group, an aryloxy group, an alkylthio group, an arylthio group, a dialkylamino group, an acyl group, an alkoxycarbonyl group, an acyloxy group, a carbamoyl group, an N-substituted carbamoyl group, a sulfamoyl group, an N-substituted sulfamoyl group, a sulfonylamino group, an alkylsulfonyl group, an arylsulfonyl group, an acylamino group, a halogen atom, a cyano group, a trifluoromethyl group and the like.

As the alkylsulfonyl group represented by $R^6$, an alkylsulfonyl group having from 1 to 20 carbon atoms is preferable, and examples thereof include a butanesulfonyl group, an octanesulfonyl group and the like.

The alkylsulfonyl group may be substituted by substitutents. Examples of these substituents include a halogen atom, an alkoxy group, an aryl group, an aryloxy group and the like.

As the arylsulfonyl group represented by $R^6$, an arylsulfonyl group having from 6 to 16 carbon atoms is preferable, and examples thereof include a p-toluenesulfonyl group, a p-chlorophenylsulfonyl group and the like.

The arylsulfonyl group represented by $R^6$ may be substituted by substituents. Examples of these substitutents include, for example, an alkyl group, an aryl group, an alkoxy group, an aryloxy group, an alkylthio group, an arylthio group, a dialkylamino group, an acyl group, an alkoxycarbonyl group, an acyloxy group, a carbamoyl group, an N-substituted carbamoyl group, a sulfamoyl group, an N-substituted sulfamoyl group, a sulfonylamino group, an alkylsulfonyl group, an arylsulfonyl group, an acylamino group, a halogen atom, a cyano group, a trifluoromethyl group and the like.

In formula (2), $R^7$ represents an alkyl group, an aryl group, an alkenyl group, or an alkinyl group. As $R^7$, an alkyl group is preferable.

As the alkyl group represented by $R^7$, an alkyl group having from 1 to 20 carbon atoms is preferable, and examples thereof include a methyl group, an ethyl group, an isopropyl group, a butyl group, a hexyl group, an octyl group, a 2-ethylhexyl group, a dodecyl group, a tetradecyl group, an octadecyl group and the like.

The alkyl group represented by $R^7$ may be substituted by substituents, and examples of substituents include an aryl group, a halogen atom, an alkoxy group, an aryloxy group, an acyl group, an alkoxycarbonyl group, a cyano group and the like.

As the aryl group represented by $R^7$, an aryl group having from 5 to 36 carbon atoms is preferable, and examples thereof include a phenyl group, a pyridyl group, a naphthyl group and the like.

The aryl group represented by $R^7$ may be substituted by substituents, and examples of substituents include an alkyl group, an aryl group, an alkoxy group, an aryloxy group, an arylthio group, a dialkylamino group, an acyl group, an alkoxycarbonyl group, an acyloxy group, a carbamoyl group, an N-substituted carbamoyl group, a sulfamoyl group, an N-substituted sulfamoyl group, a sulfonylamino group, an alkylsulfonyl group, an arylsulfonyl group, an acylamino group, a halogen atom, a cyano group, a trifluoromethyl group, and the like.

As the alkenyl group represented by $R^7$, an alkenyl group having from 3 to 20 carbon atoms is preferable, and examples thereof include an aryl group, a crotyl group, an oleyl group and the like.

The alkenyl group represented by $R^7$ may be substituted by substituents. Examples of these substitutents include a halogen atom, an alkoxy group, an aryl group, an aryloxy group, an alkoxycarbonyl group and the like.

As the alkynyl group represented by $R^7$, an alkinyl group having from 3 to 20 carbon atoms is preferable, and examples thereof include a propargyl group and the like.

The alkinyl group represented by $R^7$ may be substituted by substitutents. Examples of these substituents include a halogen atom, an alkoxy group, an aryl group, an aryloxy group, an alkoxycarbonyl group and the like.

In formula (2), $R^6$ and $R^7$ may be the same or may be different from each other.

In formula (2), Y represents an oxygen atom or a sulfur atom. As Y, an oxygen atom is preferable.

As the uracil compound represented by formula (2), the uracil compound represented by the following formula (5) is preferable from the standpoint of light fastness of images.

Formula (5)

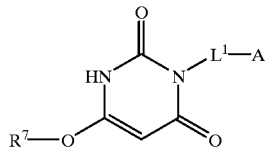

In formula (5), $R^7$ is the same as $R^7$ in formula (2). $L^1$ represents an alkylene group. A represents an aryl group, an alkoxycarbonyl group, or an N-substituted carbamoyl group.

As the alkylene group represented by $L^1$, an alkylene group having from 1 to 20 carbon atoms is preferable, and examples thereof include $—CH_2—$ group, $—(CH_2)_3—$ group, $—(CH_2)_8—$ group, $—(CH_2)_{12—}$ group, $—CH(C_6H_{13}(—n))—$ group, $—CH(C_{14}H_{29}(—n))—$ group, and the like.

The alkylene group represented by $L^1$ may be substituted by substituents. Examples of these substitutents include an aryl group, an alkoxycarbonyl group, an N-substituted carbamoyl group, an acyl group, an alkylsulfonyl group, an arylsulfonyl group and the like.

As the aryl group represented by A, an aryl group having from 5 to 36 carbon atoms is preferable, and examples thereof include a phenyl group, a pyridyl group, a naphtyl group and the like.

The aryl group represented by A may be substituted by substituents, and examples of these substituents include an alkyl group, an aryl group, an alkoxy group, an aryloxy group, an alkylthio group, an arylthio group, a dialkylamino group, an acyl group, an alkoxycarbonyl group, an acyloxy group, a carbamoyl group, an N-substituted carbamoyl group, a sulfamoyl group, an N-substituted sulfamoyl group, a sulfonylamino group, an alkylsulfonyl group, an arylsulfonyl group, an acylamino group, a halogen atom, a cyano group, a trifluoromethyl group and the like.

As the alkoxycarbonyl group represented by A, an alkoxycarbonyl group having from 2 to 27 carbon atoms is preferable, and examples thereof include a methoxycarbonyl group, an octadecyloxycarbonyl group, a 2-ethylhexyloxycarbonyl group and the like.

The alkoxycarbonyl group represented by A may be substituted by substitutents, and examples of these substitutents include an aryl group, an alkoxy group, an aryloxy group, an alkylthio group, an arylthio group, a dialkylamino group, an acyl group, an alkoxycarbonyl group, an acyloxy group, a carbamoyl group, an N-substituted carbamoyl group, a sulfamoyl group, an N-substituted sulfamoyl group, a sulfonylamino group, an alkylsufonyl group, an arylsulfonyl group, an acylamino group, a halogen atom, a cyano group, a trifluoromethyl group, and the like.

As the N-substituted carbamoyl group represented by A, an N-substituted carbamoyl group having from 2 to 27 carbon atoms is preferable. Examples thereof include an N-methylcarbamoyl group, an N-octadecylcarbamoyl group, an N,N'-dioctylcarbamoyl group, an N-(2-ethylhexyl)-N-dodecylcarbamoyl group, an N-phenylcarbamoyl group and the like.

The N-substituted carbamoyl group represented by A may be substituted by substituents. Examples of substitutents include an alkyl group, an aryl group, an alkoxy group, an aryloxy group, an alkylthio group, an arylthio group, a dialkylamino group, an acyl group, an alkoxycarbonyl group, an acyloxy group, a carbamoyl group, an N-substituted carbamoyl group, a sulfamoyl group, an N-substituted sulfamoyl group, a sulfonylamino group, an alkylsulfonyl group, an arylsulfonyl group, an acylamino group, a halogen atom, a cyano group, a trifluoromethyl group and the like.

Specific examples of the uracil compound represented by formula (2) (i.e., Compounds (C-1) to (C-80)) are shown hereinafter. In "No." columns in Table 1, the "C-"s are omitted. The combinations of $R^6$, $R^7$ and Y are not limited to the following specific examples, and any arbitrary combination can be used. However, the combinations of $R^6$, $R^7$ and Y used in the Examples which will be described later are preferable.

TABLE 1

| No. | $R^6$ | $R^7$ | Y |
|---|---|---|---|
| 1 | H | $CH_3$ | O |
| 2 | $CH_3$ | $C_2H_5$ | O |
| 3 | $C_2H_5$ | $C_2H_5$ | O |
| 4 | (i)$C_3H_7$ | (i)$C_3H_7$ | O |
| 5 | (n)$C_4H_9$ | $C_2H_5$ | O |
| 6 | (n)$C_4H_9$ | (n)$C_4H_9$ | O |
| 7 | 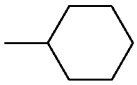 | $C_2H_5$ | O |

TABLE 1-continued

| No. | $R^6$ | $R^7$ | Y |
|---|---|---|---|
| 8 | (n)$C_8H_{17}$ | $C_2H_5$ | O |
| 9 | (n)$C_{18}H_{37}$ | $C_2H_5$ | O |
| 10 | (n)$C_{18}H_{37}$ | —$CH_2CH$=$CH_2$ | O |
| 11 | (n)$C_{18}H_{37}$ | (n)$C_6H_{13}$ | O |
| 12 | (n)$C_{18}H_{37}$ | —$CH_2CH(C_2H_5)C_4H_9$(n) | O |
| 13 | —$CH_2Cl$ | (n)$C_{18}H_{37}$ | |
| 14 | —$CH_2CH_2CH_2Cl$ | (n)$C_{18}H_{37}$ | O |
| 15 | —$CH_2COOC_2H_5$ | $C_2H_5$ | O |
| 16 | —$CH_2COOC_4H_9$(n) | $C_2H_5$ | O |
| 17 | —$CH_2COOC_4H_9$(n) | (n)$C_4H_9$ | O |
| 18 | —$CH_2COOC_8H_{17}$(n) | $C_2H_5$ | O |
| 19 | —$CH_2COOC_8H_{17}$(n) | (n)$C_8H_{17}$ | O |
| 20 | —$CH_2COOC_{12}H_{25}$(n) | $C_2H_5$ | O |
| 21 | —$CH_2COOC_{12}H_{25}$(n) | (n)$C_{12}H_{25}$ | O |
| 22 | —$CH_2COOC_{14}H_{29}$(n) | $C_2H_5$ | O |
| 23 | —$CH_2COOC_{14}H_{29}$(n) | (n)$C_{14}H_{29}$ | O |
| 24 | —$CH_2COOC_{18}H_{37}$(n) | $C_2H_5$ | O |
| 25 | —$CH_2COOC_{18}H_{37}$(n) | (n)$C_{18}H_{37}$ | O |
| 26 | —$CH_2COOC_{12}H_{25}$(n) | —$CH_2$—$C_6H_5$ | O |
| 27 | —$CH_2COOC_{12}H_{25}$(n) | —$CH_2CH_2CH$=$CH_2$ | O |
| 28 | $CH_2COOC_{12}H_{25}$(n) | —$CH_2CH_2$—O—$C_6H_5$ | O |
| 29 | —$CH_2COOC_{14}H_{29}$(n) | —$CH_2CH_2Cl$ | O |
| 30 | —$CH_2COOC_{14}H_{29}$(n) | —$CH_2CF_3$ | O |
| 31 | —$CH_2COOC_{18}H_{37}$(n) | —$CH_2CH_2OCH_3$ | O |
| 32 | —$CH_2CONHC_8H_{17}$(n) | $C_2H_5$ | O |
| 33 | —$CH_2CON[(n)C_8H_{17}]_2$ | —$CH_2CN$ | O |
| 34 | —$CH_2CON[(n)C_{12}H_{25}]_2$ | —$CH_2CF_3$ | O |
| 35 | (n)$C_{18}H_{37}$ | —$CH_2COCH_3$ | O |
| 36 | (n)$C_{18}H_{37}$ | —$CH_2COOCH_3$ | O |
| 37 | —$C_6H_5$ | $C_2H_5$ | O |
| 38 | —$C_5H_4N$ | $C_2H_5$ | O |
| 39 | —$C_6H_3Cl_2$ (Cl, Cl) | $C_2H_5$ | O |
| 40 | —$C_6H_3Cl_2$ (Cl, Cl) | $C_2H_5$ | O |

TABLE 1-continued
| No. | $R^6$ | $R^7$ | Y |
|---|---|---|---|
| 41 | 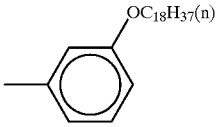 | $C_2H_5$ | O |
| 42 | 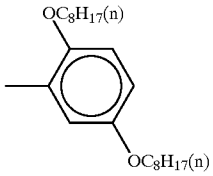 | $C_2H_5$ | O |
| 43 | 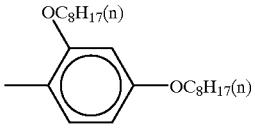 | $C_2H_5$ | O |
| 44 | 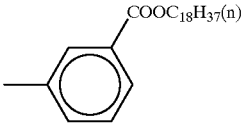 | $C_2H_5$ | O |
| 45 | 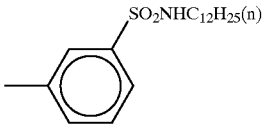 | $C_2H_5$ | O |
| 46 | 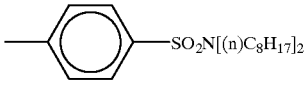 | $C_2H_5$ | O |
| 47 | 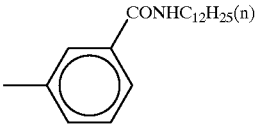 | $C_2H_5$ | O |
| 48 | 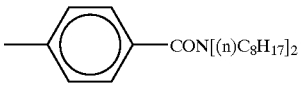 | $C_2H_5$ | O |
| 49 | $(n)C_{18}H_{37}$ | 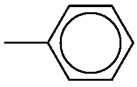 | O |
| 50 | 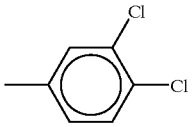 | 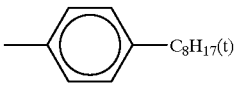 | O |
| 51 | 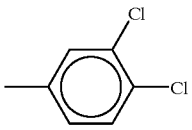 | 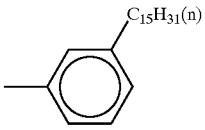 | O |

TABLE 1-continued
| No. | $R^6$ | $R^7$ | Y |
|---|---|---|---|
| 52 | 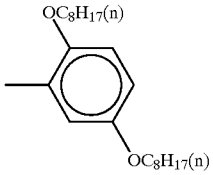 | 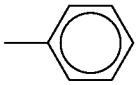 | O |
| 53 | 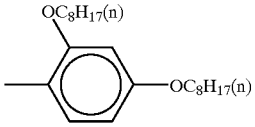 | 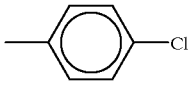 | O |
| 54 | 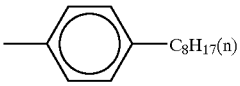 | 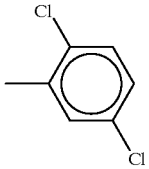 | O |
| 55 | $—CH_2COOC_{18}H_{37}(n)$ | 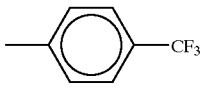 | O |
| 56 | 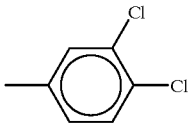 | 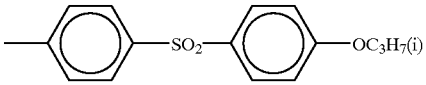 | O |
| 57 | $—CH_2COOC_{18}H_{37}(n)$ | 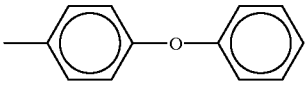 | O |
| 58 | $—CH_2CON[(n)C_8H_{17}]_2$ | 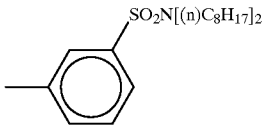 | O |
| 59 | $—CH_2CON[(n)C_8H_{17}]_2$ | 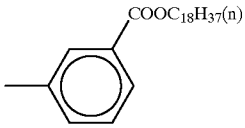 | O |
| 60 | $—CH_2COOC_{18}H_{37}(n)$ | 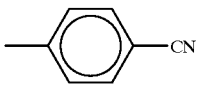 | O |
| 61 | 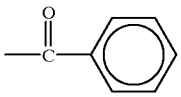 | $(n)C_{18}H_{37}$ | O |
| 62 | 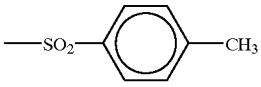 | $(n)C_{18}H_{37}$ | O |

TABLE 1-continued
| No. | $R^6$ | $R^7$ | Y |
|---|---|---|---|
| 63 | 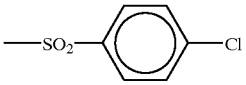 | $—CH_2CH=CH_2$ | O |
| 64 | $—SO_2C_8H_{17}(n)$ | $—CH_2C\equiv CH$ | O |
| 65 | $(n)C_4H_9$ | $(n)C_{18}H_{37}$ | S |
| 66 | 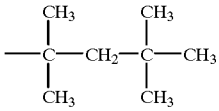 | 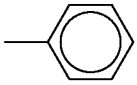 | S |
| 67 | $(t)C_4H_9$ | $—CH_2CHC_4H_9(n)$ <br> $C_2H_5$ | S |
| 68 | 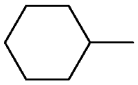 | $—CH_2CHC_4H_9(n)$ <br> $C_2H_5$ | S |
| 69 | 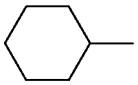 | $(n)C_{18}H_{37}$ | S |
| 70 | 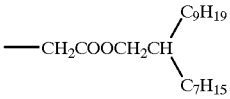 | $—CH_3$ | O |
| 71 | 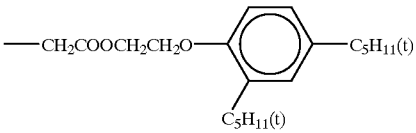 | $—CH_3$ | O |
| 72 | 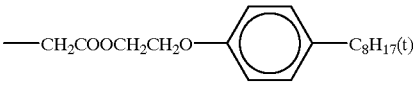 | $—CH_3$ | O |
| 73 | 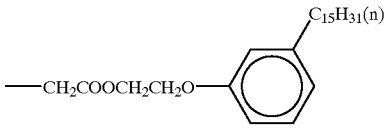 | $—CH_3$ | O |
| 74 | $—CH_2CON(C_8H_{17}(n))_2$ | $—CH_3$ | O |
| 75 | 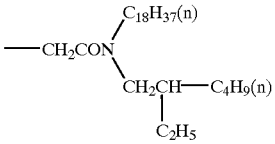 | $—CH_3$ | O |
| 76 | 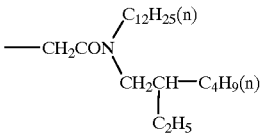 | $—CH_3$ | O |

TABLE 1-continued

| No. | $R^6$ | $R^7$ | Y |
|---|---|---|---|
| 77 | 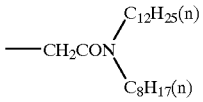 | $-CH_3$ | O |
| 78 | 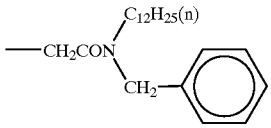 | $-CH_3$ | O |
| 79 | 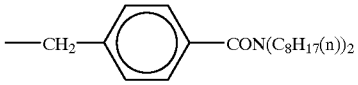 | $-CH_3$ | O |
| 80 | 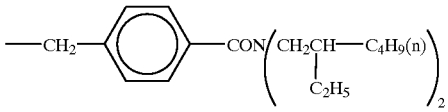 | $-CH_3$ | O |

The uracil compound represented by formula (2) may be suitably synthesized and may be a commercial product.

A synthesis example of Compound (C-74) which is a uracil compound represented by formula (2) will be described hereinafter.

13.8 g (0.2 mol) of zinc powder was added to 30 ml of acetic acid, and the solution was heated to 95° C. 10.8 g (0.02 mol) of 1-phenacyl-3-(N,N-di-n-octylcarbamoyl)-6-methoxyuracil was added to the solution, and then the resultant solution was stirred for 7 hours at 100° C. The zinc powder was removed from the reaction solution by Celite filtration, and the filtrate was mixed with water and extracted by ethyl acetate. After removing the ethyl acetate, n-hexane was added, and crystals were obtained by filtration. As a result, 4.2 g of Compound (C-74) was obtained (in a yield of 50%). The melting point of the compound was 121–122° C.

The uracil compound represented by formula (2) may be used alone or in combinations of two or more kinds.

A detailed description will be given of the barbituric acid compound represented by above formula (3), which is another coupling component used in combination with the benzenediazonium salt compound represented by formula (1).

In formula (3), $R^8$ and $R^9$ each independently represents a hydrogen atom, an alkyl group, an aryl group, an acyl group, an alkylsulfonyl group, or an arylsulfonyl group. As $R^8$ and $R^9$, an alkyl group or an aryl group is preferable.

As the alkyl group represented by $R^8$ and $R^9$, an alkyl group having from 1 to 28 carbon atoms is preferable, and examples thereof include a methyl group, an ethyl group, a butyl group, a cyclohexyl group, an octyl group, an octadecyl group and the like.

The alkyl group represented by $R^8$ and $R^9$ may be substituted by substituents. Examples of these substituents include a halogen atom, an alkoxycarbonyl group, an N-substituted carbamoyl group, an aryl group, an alkoxy group, an aryloxy group and the like.

As the aryl group represented by $R^8$ and $R^9$, an aryl group having from 5 to 36 carbon atoms is preferable, and examples thereof include a phenyl group, a pyridyl group, a naphtyl group and the like.

The aryl group represented by $R^8$ and $R^9$ may be substituted by substituents. Examples of these substituents include an alkyl group, an aryl group, an alkoxy group, an aryloxy group, an alkylthio group, an arylthio group, a dialkylamino group, an acyl group, an alkoxycarbonyl group, an acyloxy group, a carbamoyl group, an N-substituted carbamoyl group, a sulfamoyl group, an N-substituted sulfamoyl group, a sulfonylamino group, an alkylsulfonyl group, an arylsulfonyl group, an acylamino group, a halogen atom, a cyano group, a trifluoromethyl group and the like.

As the acyl group represented by $R^8$ and $R^9$, an acyl group having 1 to 30 carbon atoms is preferable, and examples thereof include an acetyl group, a pivaryol group, a benzoyl group and the like.

The acyl group represented by $R^8$ and $R^9$may be substituted by substituents. Examples of these substituents include an alkyl group, an aryl group, an alkoxy group, an aryloxy group, an alkylthio group, an arylthio group, a dialkylamino group, an acyl group, an alkoxycarbonyl group, an acyloxy group, a carbamoyl group, an N-substituted carbamoyl group, a sulfamoyl group, an N-substituted sulfamoyl group, a sulfonylamino group, an alkylsulfonyl group, an arylsulfonyl group, an acylamino group, a halogen atom, a cyano group, a trifluoromethyl group and the like.

As the alkylsulfonyl group represented by $R^8$ and $R^9$, an alkylsulfonyl group having from 1 to 20 carbon atoms is preferable, and examples thereof include a butanesulfonyl group, an octanesulfonyl group and the like.

The alkylsulfonyl group represented by $R^8$ and $R^9$ may be substituted by substituents. Examples of these substituents include a halogen atom, an alkoxy group, an aryl group, an aryloxy group and the like.

As the arylsulfonyl group represented by $R^8$ and $R^9$, an arylsulfonyl group having from 6 to 16 carbon atoms is preferable. Examples thereof include a p-toluenesulfonyl group, a p-chlorophenylsulfonyl group and the like.

The arylsulfonyl group represented by $R^8$ and $R^9$ may be substituted by substituents. Examples of these substituents include an alkyl group, an aryl group, an alkoxy group, an aryloxy group, an alkylthio group, an arylthio group, a dialkylamino group, an acyl group, an alkoxycarbonyl group, an acyloxy group, a carbamoyl group, an N-substituted carbamoyl group, a sulfamoyl group, an N-substituted sulfamoyl group, a sulfonylamino group, an alkylsulfonyl group, an arylsulfonyl group, an acylamino group, a halogen atom, a cyano group, a trifluoromethyl group and the like.

In formula (3), $R^8$ and $R^9$ may be the same or may be different from each other.

As the barbituric acid compound represented by formula (3), the barbituric acid compound represented by the following formula (6) is preferable from the standpoint of light fastness of images.

Formula (6)

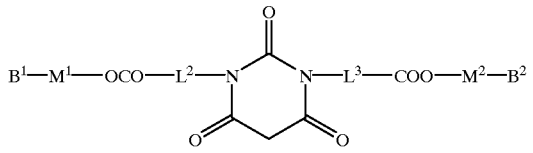

In formula (6), $L^2$, $L^3$, $M^1$ and $M^2$ each independently represents an alkylene group. $B^1$ and $B^2$ each independently represents an aryloxy group and an arylthio group.

As the alkylene group represented by $L^2$, $L^3$, $M^1$ and $M^2$, an alkylene group having from 1 to 20 carbon atoms is preferable, and examples thereof include —$CH_2$— group, —$(CH_2)_2$— group, —$(CH_2)_3$— group, —$(CH_2)_9$— group, —$(CH_2)_{12}$— group, —$CH(C_6H_{13}(—n))$— group, —$CH(C_{14}H_{29}(—n))$— group and the like.

The alkylene group represented by $L^2$, $L^3$, $M^1$ and $M^2$ may be substituted by substituents, and examples of the substituents include an aryl group, an alkoxycarbonyl group, an N-substituted carbamoyl group, an acyl group, an alkylsulfonyl group, an arylsulfonyl and the like.

As the aryloxy group represented by $B^1$ and $B^2$, an aryloxy group having from 6 to 36 carbon atoms is preferable, and examples thereof include a phenoxy group, a naphthyloxy group and the like.

The aryloxy group represented by $B^1$ and $B^2$ may be substituted by substituents, and examples of these substituents include an alkyl group, an alkoxy group, an aryloxy group, an alkylthio group, an arylthio group, an alkylsulfonyl group, an arylsulfonyl group, a halogen atom and the like.

As the arylthio group represented by $B^1$ and $B^2$, an arylthio group having from 6 to 36 carbon atoms is preferable, and examples thereof include a phenylthio group, a naphthylthio group and the like.

The arylthio group represented by $B^1$ and $B^2$ may be substituted by substituents, and examples of these substituents include an alkyl group, an alkoxy group, an aryloxy group, an alkylthio group, an arylthio group, an alkylsulfonyl group, an arylsulfonyl group, a halogen atom and the like.

Specific examples of the barbituric acid compound represented by the above formula (3) (Composites (D-1) to (D-45)) will be shown hereinafter. In the "No." column in Table 2, the "D-"s are omitted. The combinations of $R^8$ and $R^9$ are not limited to these specific examples and may be any combination. The combinations of $R^8$ and $R^9$ which are used in the Examples described later are preferable.

TABLE 2

| No. | $R^8$ | $R^9$ |
|---|---|---|
| 1 | —$CH_2COOC_{18}H_{37}$(n) | —$CH_2COOC_{18}H_{37}$(n) |
| 2 | —$CH_2COOC_{10}H_{21}$(n) | —$CH_2COOC_{10}H_{21}$(n) |
| 3 | —$CH_2COOC_{14}H_{29}$(n) | —$CH_2COOC_{14}H_{29}$(n) |
| 4 | —$CH_2COOC_{12}H_{25}$(n) | —$CH_2COOC_{12}H_{25}$(n) |
| 5 | —$CH_2COOC_9H_{19}$(n) | —$CH_2COOC_9H_{19}$(n) |
| 6 | —$CH_2COOCH_2CH_2O$— 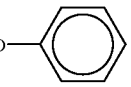 | —$CH_2COOCH_2CH_2O$— 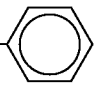 |
| 7 | $CH_3O$ 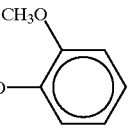 —$CH_2COOCH_2CH_2O$— | $CH_3O$ 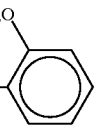 —$CH_2COOCH_2CH_2O$— |
| 8 | (n)$C_6H_{13}O$ 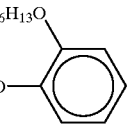 —$CH_2COOCH_2CH_2O$— | (n)$C_6H_{13}O$ 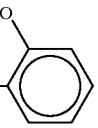 —$CH_2COOCH_2CH_2O$— |
| g | (n)$C_8H_{17}O$ 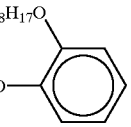 —$CH_2COOCH_2CH_2O$— | (n)$C_8H_{17}O$ 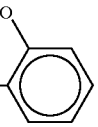 —$CH_2COOCH_2CH_2O$— |

TABLE 2-continued
| No. | $R^8$ | $R^9$ |
|---|---|---|
| 10 | 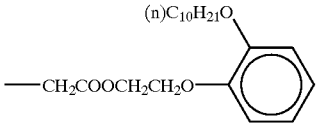 | 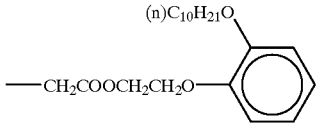 |
| 11 | 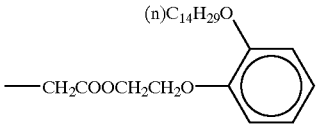 | 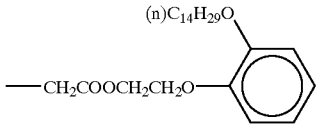 |
| 12 | 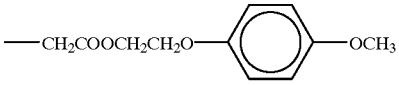 | 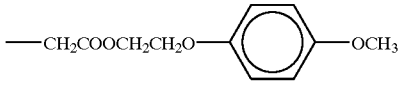 |
| 13 | 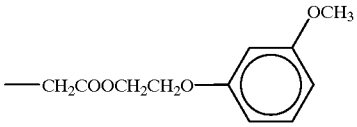 | 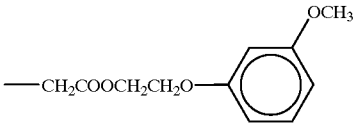 |
| 14 | 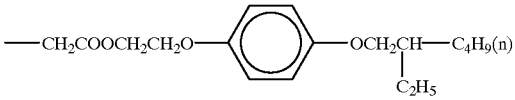 | 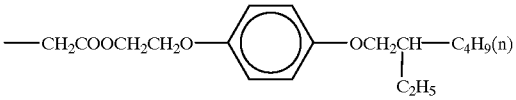 |
| 15 | 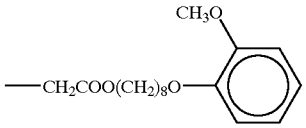 | 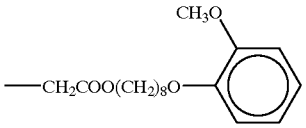 |
| 16 | 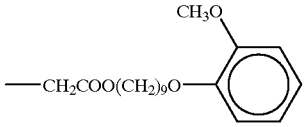 | 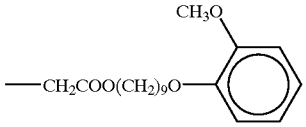 |
| 17 | 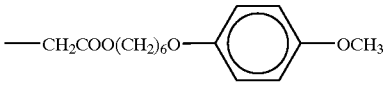 | 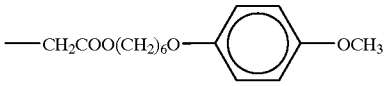 |
| 18 | $—CH_2COOCH_2CH_2OC_8H_{13}(n)$ | $—CH_2COOCH_2CH_2OC_6H_{13}(n)$ |
| 19 | 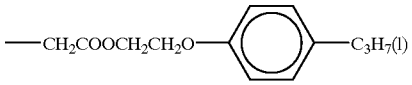 | 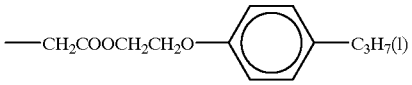 |
| 20 | 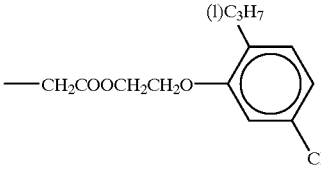 | 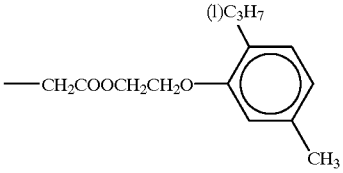 |
| 21 | 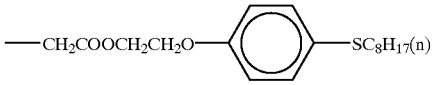 | 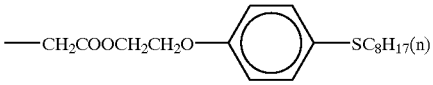 |

TABLE 2-continued

| No. | $R^8$ | $R^9$ |
|---|---|---|
| 22 | $—CH_2COOCH_2CH_2O—C_6H_4—SO_2C_5H_{17}(n)$ | $—CH_2COOCH_2CH_2O—C_6H_4—SO_2C_5H_{17}(n)$ |
| 23 | $—CH_2COOCH_2CH_2O—C_6H_4—O—C_6H_5$ | $—CH_2COOCH_2CH_2O—C_6H_4—O—C_6H_5$ |
| 24 | $—CH(CH_3)COOC_{14}H_{29}(n)$ | $—CH(CH_3)COOC_{14}H_{29}(n)$ |
| 25 | $—CH_2COOCH_2CH_2O—C_6H_3(OC_8H_{17}(n))$ | $—C_6H_5$ |
| 26 | $—CH_2COOCH_2CH_2O—C_6H_3(OC_{14}H_{29}(n))$ | $—C_6H_{11}$ |
| 27 | $—CH_2COOCH_2CH_2O—C_6H_3(OCH_3)$ | $—C_6H_4—OC_{12}H_{25}(n)$ |
| 28 | $—CH_2COOCH_2CH_2O—C_6H_3(OCH_3)$ | $—C_6H_4—OC_{14}H_{29}(n)$ |
| 29 | $—CH_2COOC_{14}H_{29}(n)$ | $—C_6H_3(OC_8H_{17}(n))(OC_8H_{17}(n))$ |
| 30 | $—CH_2CH_2COOC_{16}H_{33}(n)$ | $—CH_2CH_2COOC_{16}H_{33}(n)$ |
| 31 | $—CH_2CH_2COOCH_2CH_2O—C_6H_3(OCH_3)$ | $—CH_2CH_2COOCH_2CH_2O—C_6H_3(OCH_3)$ |
| 32 | $—CH_2CON(CH_2CH(C_2H_5)—C_4H_9(n))_2$ | $—CH_2CON(CH_2CH(C_2H_5)—C_4H_9(n))_2$ |

TABLE 2-continued
| No. | $R^8$ | $R^9$ |
|---|---|---|
| 33 | 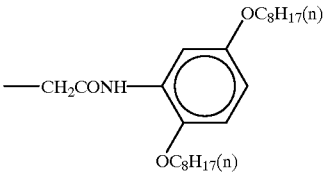 | 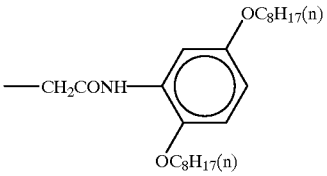 |
| 34 | 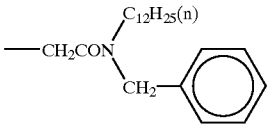 | 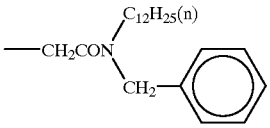 |
| 35 | $—CH_2CON(C_8H_{17}(n))_2$ | —H |
| 36 | 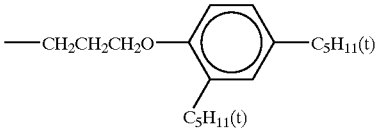 | 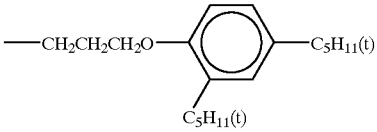 |
| 37 | 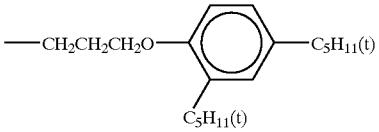 | 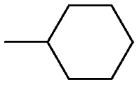 |
| 38 | $—CH_2CONHCH_2COOC_{18}H_{37}(n)$ | $—CH_2CONHCH_2COOC_{18}H_{37}(n)$ |
| 39 | $—CH_2SO_2N(C_8H_{17}(n))_2$ | $—CH_2SO_2N(C_8H_{17}(n))_2$ |
| 40 | 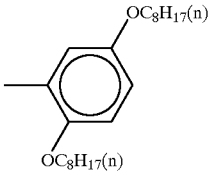 | 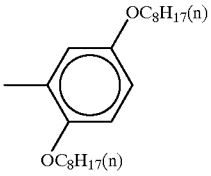 |
| 41 | 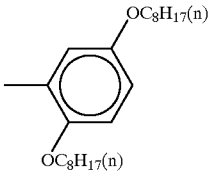 | 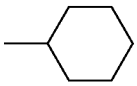 |
| 42 | 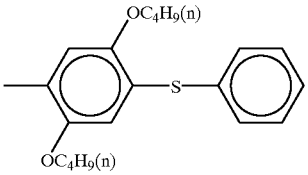 | 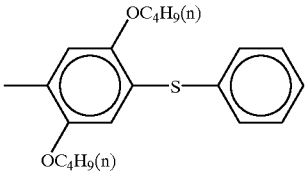 |
| 43 | 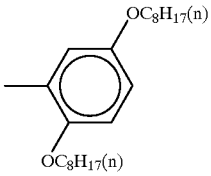 | 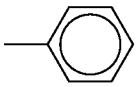 |

TABLE 2-continued

| No. | $R^8$ | $R^9$ |
|---|---|---|
| 44 | 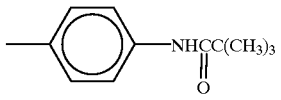 | 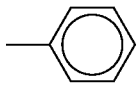 |
| 45 | 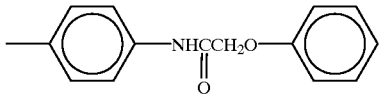 | 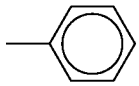 |

The barbituric acid compound represented by formula (3) may be suitably synthesized or may be a commercial product. An example of such a commercial product is "1,3-dimethylbarbituric acid" (manufactured by Tokyo Chemical Industry Co., Ltd.).

A synthesis example of the specific compound (D-7) which is a barbituric acid compound represented by formula (3) is shown below.

47.6 g (0.1 mol) of 1,3-di(2-(2-methoxyphenoxy) ethoxycarbonylmethyl)urea, 18.72 g (0.18 mol) of malonic acid, 36.75 g (0.36 mol) of acetic anhydride, and 700 ml of ethyl acetate were mixed, and were refluxed for 4 hours. After removing 400 ml of ethyl acetate, 300 ml of methanol was added, the resultant crystals were collected by filtration. As a result, 30.8 g of Compound (D-7) was obtained (in a yield of 57%). The melting point of the compound was 137–138° C.

The barbituric acid compound represented by formula (3) may be used alone or in a combination of two or more kinds, may be used.

The uracil compound represented by formula (2) and the barbituric acid compound represented by formula (3), which are coupling components, may be used together.

For adjustment of the hue or the like, a known coupling component, which forms a dye by coupling with the diazonium salt compound in a basic atmosphere, may be used together with at least one of the uracil compound represented by formula (2) and the barbituric acid compound represented by formula (3). It is preferable that 50% by weight or more of the entire amount of the coupling components to be used is at least one of the uracil compound represented by formula (2) and the barbituric acid compound represented by formula (3).

Examples of such known coupling components include a so-called active methylene compound which has a methylene group adjacent to the carbonyl group, a phenol derivative, a naphthol derivative, and the like.

Specific examples of the known coupling component include resorcin, phloroglucin, sodium 2,3-dihydroxynaphthalene-6-sulfonate, 1-hydroxy-2-(morpholinopropyl)naphthoamide, 1,5-dihydroxynaphthalene, 2,3-dihydroxynaphthalene, 2,3-dihydroxy-6-sulfo-naphthalene, 2-hydroxy-3-(morpholinopropyl) naphthoamide, 2-hydroxy-3-octylnaphthoamide, 2-hydroxy-3-naphthoanilide, benzoylacetanilide, 1-phenyl-3-methyl-5-pyrazolone, 1-(2,4,6-trichlorophenyl)-3-anilino-5-pyrazolone, 2-[3-[α-(2,4-di-tert-amylphenoxy)butanamido]benzamido]phenol, 2,4-bis-(benzoylacetamino)toluene, 1,3-bis-(pivaloylacetaminomethyl)benzene and the like.

A detailed description will be given hereinafter of the heat-sensitive recording material of the present invention.

The heat-sensitive recording material is provided with, on a support, the heat-sensitive recording layer containing the benzenediazonium salt compound represented by formula (1), which is a diazonium salt compound, and a coupling component which is the uracil compound represented by formula (2) or the barbituric acid compound represented by formula (3). It is preferable that the diazonium salt compound is encapsulated in microcapsules, from the standpoint of storability before use.

The method of forming the microcapsules can be a known process. The polymer substance forming the walls of the microcapsules may be impermeable at room temperature and become permeable upon heating. In particular, a polymer having a glass transition temperature in the range of from 60 to 200° C. is preferable. Examples thereof include polyurethanes, polyureas, polyamides, polyesters, urea-formaldehyde resins, melamine resins, polystyrenes, styrene-methacrylate copolymers, styrene-acrylate copolymers, and mixtures thereof.

As the method of forming the microcapsules, an interfacial polymerization method and an internal polymerization method are suitable. Details of methods of forming microcapsules and specific examples of reactants are described in U.S. Pat. Nos. 3,726,804, 3,796,669 and the like. For example, when polyurea or polyurethane is used as a capsule wall material, polyisocyanate and a second substance (for example, polyol or polyamine) forming capsule walls by reacting with the polyisocyanate are mixed in an aqueous medium or an oily medium for encapsulating. The mixture is emulsified in water, and then heated, whereby a polymerization reaction occurs at the interface between the oil phase and the aqueous phase to form walls of microcapsules. In addition, even when the addition of the above-described second substance is omitted, polyurea is formed.

The polymer forming the walls of the microcapsules is preferably at least one kind selected from polyurethane and polyurea.

The method of producing the diazonium salt-containing microcapsules (polyurea-polyurethane walls) in the present invention is explained below.

First, the diazonium salt compound is dissolved or dispersed in a hydrophobic organic solvent which becomes the microcapsule core. As the organic solvent in this case, at least one type of a solvent selected from halogenated hydrocarbons, carboxylic acid esters, carboxamides, phosphoric acid esters, carbonic acid esters, ketones, ethers, alkylated biphenyls, alkylated terphenyls, and alkylated naphthalenes is preferable. Into the core solvent is further added a polyhydric isocyanate as the wall material (oil phase).

On the other hand, as the aqueous phase, an aqueous solution having dissolved therein a water-soluble polymer such as polyvinyl alcohol, gelatin, or the like is prepared. Then after adding thereto the above-described oil phase, the mixture is emulsified and dispersed by a means such as a homogenizer or the like. In this case, the water-soluble polymer functions as a stabilizer for the emulsification and dispersion. To carry out the emulsification and dispersion more stably, a surface active agent may be added to at least one of the oil phase and the aqueous phase.

The amount of the polyhydric isocyanate used is determined such that the mean particle diameter of the microcapsules is from 0.3 to 12 μm and the wall thickness is from 0.01 to 0.3 μm. The dispersed particle diameters are generally from about 0.2 to 10 μm. In the emulsified dispersion, the polymerization reaction of the polyhydric isocyanate occurs at the interface of the oil phase and the aqueous phase to form polyurea walls.

When polyol is added into the aqueous phase in advance, the polyhydric isocyanate reacts with the polyol, whereby polyurethane walls can be formed. To accelerate the reaction rate, it is preferable to keep the reaction temperature high or to add a suitable polymerization catalyst. The polyhydric isocyanates, polyols, reaction catalysts, polyamines for forming a part of the walls of the microcapsules and the like are described in detail, for example, in Keiji Iwata (ed.), "*Polyurethane Handbook*", published by Nikkan Kogyo Shinbun-sha, 1987.

As the hydrophobic organic solvent in the case of dissolving the diazonium salt compound and forming the cores of microcapsules as described above, an organic solvent having a boiling point of from 100 to 300° C. is preferable. Specific examples include an alkyl naphthalene, an alkyl diphenylethane, an alkyl diphenylmethane, an alkyl biphenyl, chlorinated paraffin, tricresyl phosphate, maleic acid esters, adipic acid esters, sulfuric acid esters, and sulfonic acid esters. The hydrophobic organic solvents can be used singly or as a mixture of two or more kinds thereof.

When the solubility, in the solvent, of the diazonium salt compound to be encapsulated in the solvents is low, a low-boiling point solvent having a high solubility for the diazonium salt compound used can also be used. Specific examples of the low-boiling point solvent include ethyl acetate, butyl acetate, methylene chloride, tetrahydrofuran, acetone and the like. Also, when only a low-boiling point solvent is used, during the microencapsulation reaction, the solvent is evaporated off and so-called coreless microcapsules are formed wherein the capsule wall and the diazonium salt compound integrally exist.

As the polyhydric isocyanate compound used as the raw material for the walls of microcapsules, a ter-functional or higher-functional isocyanate compound is preferable but a bifunctional isocyanate compound may also be used together with a ter-functional or higher-functional isocyanate compound. Specifically, there are the dimers or trimers (biulets or isocyanurates) of diisocyanates such as xylene diisocynate or the hydrogenated product thereof, hexamethylene diisocyanate, tolylene diisocyanate or the hydrogenated product thereof and the like, as the main raw material; the polyfunctional isocyanate compounds obtained as the adducts of the above-described diisocyanates and a polyol such as trimethylolpropane, or the like; formalin condensate of benzene isocyanate; and the like.

Furthermore, a polyol or a polyamine is added to the hydrophobic solvent which becomes the cores of the microcapsules or to a water-soluble high molecular compound solution which becomes a disperse medium, and the polyol or the polyamine can be used as one of the raw materials for the walls of the microcapsules. Specific examples of these polyols or polyamines include propylene glycol, glycerine, trimethylolpropane, triethanolamine, sorbitol, hexamethylenediamine and the like. When a polyol is added, polyurethane walls are formed.

As the water-soluble polymer used for the water-soluble polymer solution for dispersing the oil phase of microcapsules thus prepared, a water-soluble polymer having a solubility in water of at least 5 wt % at a temperature at which the system is emulsified is preferable. Specific examples thereof include polyvinyl alcohol and modified materials thereof, polyacrylamide and derivatives thereof, an ethylene-vinyl acetate copolymer, a styrene-maleic anhydride copolymer, an ethylene-maleic anhydride copolymer, an isobutylene-maleic anhydride copolymer, polyvinyl pyrrolidone, an ethylene-acrylic acid copolymer, a vinyl acetate-acrylic acid copolymer, carboxymethyl cellulose, methyl cellulose, casein, gelatin, starch derivatives, gum arabic, and sodium alginate and the like.

It is preferable that these water-soluble polymers have no or low reactivity with an isocyanate compound and, for example, in the case of using a water-soluble polymer having a reactive amino group in the molecule chain, such as gelatin, it is necessary to eliminate the reactivity by modifying the polymer in advance.

Also, in the case of adding a surface active agent, the addition amount of the surface active agent is preferably from 0.1% to 5%, and particularly preferably from 0.5% to 2%, based on the weight of the oil phase.

For the emulsification, a known emulfying means such as a homogenizer, a Manton-Gaulin, an ultrasonic disperser, a dissolver, a KD mill, or the like can be used. After the emulsification, the emulsified product is heated to a temperature of from 30 to 70° C. to accelerate the microcapsule wall forming reaction. To prevent the flocculation of microcapsules with each other during the reaction, it is necessary to lower the possibility of collision of the microcapsules with each other by adding water or by stirring well.

Also, during the reaction, a dispersant may be added to prevent flocculation. With the progress of the polymerization reaction, the generation of a carbonic acid gas is observed, and with the cessation of the generation of the gas, the capsule wall formation reaction can be considered to be finished. Usually, by reacting for several hours, the desired diazonium salt compound-containing microcapsules can be obtained.

In the heat-sensitive recording material of the present invention, an organic base is added to accelerate the coupling reaction between the diazonium salt compound and the coupling component. These organic bases may be added singly or as a combination of two or more types thereof. Examples of the basic substances include nitrogen-containing compounds such as tertiary amines, piperidines, piperazines, amidines, formamidines, pyridines, guanidines, morpholines, and the like. Also, the basic materials described in Japanese Patent Application Publication (JP-B) No. 52-46806, Japanese Patent Application Laid-Open (JP-A) Nos. 62-70082, 57-169745, 60-94381, 57-123086, 58-1347901, and 60-49991, JP-B Nos. 2-24916 and 2-28479, JP-A Nos. 60-165288 and 57-185430 can be used.

Among these compounds, the following are preferable: piperazines such as N,N'-bis(3-phenoxy-2-hydroxypropyl)piperazine, N,N'-bis[3-(p-methylphenoxy)-2-hydroxypropyl]piperazine, N,N'-bis[3-(p-methoxyphenoxy)-2-hydroxypropyl]piperazine, N,N'-bis(3-phenylthio-2-hydroxypropyl)piperazine, N,N'-bis[3-(β-naphthoxy)-2-hydroxypropyl]piperazine, N-3-(β-naphthoxy)-2-hydroxypropyl-N'-methylpiperazine, 1,4-bis{

[3-(N-methylpiperazino)-2-hydroxy]propyloxy}benzene, and the like; morpholines such as N-[3-(β-naphthoxy)-2-hydroxy]propylmorpholine, 1,4-bis(3-morpholino-2-hydroxy-propyloxy)benzene, 1,3-bis(3-morpholino-2-hydroxy-propyloxy)benzene, and the like; piperidines such as N-(3-phenoxy-2-hydroxypropyl)piperidine, N-dodecylpiperidine, and the like; guanidines such as triphenylguanidine, tricyclohexylguanidine, dicyclohexylphenylguanidine, and the like; and the like.

In the heat-sensitive recording materials of the present invention, it is preferable that the amount of the coupling component used per part by weight of the diazonium salt compound and the amount of the organic base used for per part by weight of the diazonium salt compound are each from 0.1 to 30 parts by weight.

In the heat-sensitive recording materials of the present invention, in addition to the above-described organic base, a color formation aid can be added for the purpose of accelerating the color formation reaction.

The color formation aid is a material that increases the density of color formation when recording by heating or lowers the minimum color formation temperature, and makes the diazonium salt compound more liable to react with the coupling component by lowering the melting points of the coupling component, the organic base, or the diazonium salt compound, or the like, or and by lowering the softening point of the walls of the microcapsules.

As the materials included in the color formation aid used for the heat-sensitive recording material of the present invention, there are, for example, phenol derivatives, naphthol derivatives, alkoxy-substituted benzenes, alkoxy-substituted naphthalenes, aromatic ethers, thioethers, esters, amides, ureides, urethanes, sulfonamide compounds, hydroxy compounds, and the like, which are used in the color formation layers and act such that the thermal printing is carried out quickly and completely at a low level of expended energy.

The color formation aids which can be used for the heat-sensitive recording materials of the present invention also include heat-melting substances. A heat-melting substance is a substance which is a solid at normal temperatures, has a melting point of from 50 to 150° C., and is melted by heating, and dissolves the diazonium salt compound, the coupling component, or the organic base. Specific examples of these compounds include carboxamides, N-substituted carboxamides, ketone compounds, urea compounds, esters, and the like.

In the heat-sensitive recording materials of the present invention, it is preferable to use the known antioxidants, and the like, shown below for the purposes of improving the color fastness of the thermally color-developed images to light and heat or reducing yellowing of the unprinted portions due to exposure to light after fixing.

Known antioxidants are described, for example, in EP-A Nos. 223739, 309401, 309402, 310551, 310552, and 459416; DE-A No. 3,435,443; JP-A Nos. 54-48535, 62-262047, 63-113536, 63-163351, 2-262654, 2-71262, 3-121449, 5-61166, and 5-119449; U.S. Pat. Nos. 4,814,262 and 4,980,275; and the like.

In the heat-sensitive recording materials of the present invention, it is effective to further use various kinds of known additives already used for conventional heat-sensitive recording materials and pressure-sensitive recording materials. Specific examples of these additives are described in JP-A Nos. 60-107384, 60-107383, 60-125470, 60-125471, 60-125472, 60-287485, 60-287486, 60-287487, 60-287488, 61-160287, 61-185483, 61-211079, 62-146678, 62-146680, 62-146679, 62-282885, 63-051174, 63-89877, 63-88380, 63-088381, 63-203372, 63-224989, 63-251282, 63-267594, 63-182484, 1-239282, 4-291685, 4-291684, 5-188687, 5-188686, 5-110490, 5-1108437 and 5-170361; JP-B Nos. 48-043294 and 48-033212, and the like.

Specific examples are 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4-tetrahydroquinoline, nickel cyclohexanate, 2,2-bis(4-hydroxyphenyl)propane, 1,1-bis (4-hydroxyphenyl)-2-ethylhexane, 2-methyl-4-methoxy-diphenylamine, 1-methyl-2-phenylindole, and the like.

The addition amount of the antioxidant is preferably from 0.05 to 100 parts by weight, and particularly preferably from 0.2 to 30 parts by weight, per part by weight of the diazonium salt compound.

The known antioxidants can be used in the microcapsules together with the diazonium salt compound, or can be used as a solid dispersion together with the coupling component, the organic base, or others, such as a color formation aid, or the like, or as an emulsion with a proper emulsification aid, or can be used in both forms. Also, as a matter of course, a single antioxidant or plural antioxidants may be used. Further, the antioxidant can be added to a protective layer formed on the heat-sensitive recording layer.

These antioxidants need not always be added to the same layer. Furthermore, when a combination of plural antioxidants is used, they are classified by structure, for example, are classified into anilines, alkoxybenzenes, hindered phenols, hindered amines, hydroquinone derivatives, phosphorus compounds, and sulfur compounds. Antioxidants having different structures may be combined, or antioxidants having the same structure can be combined.

The coupling component used in the present invention can be used in union with the water-soluble polymer by solid-dispersing with a sand mill, or the like. An organic base and others such as a color formation aid or the like can also be used, but it is preferable that after dissolving the coupling component in an organic solvent which is only slightly soluble or insoluble in water, the solution is mixed with an aqueous phase containing a surface active agent and/or the water-soluble polymer as a protective colloid to form an emulsion. From the view point of facilitating emulsification and dispersion, it is preferable to use a surface active agent.

The organic solvent used in this case can be suitably selected from the high-boiling point oils described in, for example, JP-A No. 2-141279.

Of these high-boiling point oils, from the view point of emulsification stability of the emulsion dispersion, the use of esters is preferable, and in particular, the use of tricresyl phosphate is preferable.

As the organic solvent, plural types of high boiling point oils may be used together, or a high boiling point oil may be used together with other types of oils.

To the above-described organic solvent can be further added an auxiliary solvent as a low-boiling point dissolution aid. As such an auxiliary solvent, for example, ethyl acetate, isopropyl acetate, butyl acetate, methylene chloride and the like are particularly preferable. In some cases, no high-boiling point oil is added and only the low-boiling point auxiliary solvent is used.

The water-soluble polymer which is added as a protective colloid to the aqueous phase mixed with the oil phase containing these components can be suitably selected from known anionic polymers, nonionic polymers, and amphoteric polymers. Examples of preferred surface active agents include a sodium alkylbenzene sulfonate, a sodium alkyl sulfate, a sodium dioctyl sulfosuccinate, a polyalkylene glycol (for example, polyoxyethylene nonylphenyl ether), and the like.

In the heat-sensitive recording material of the present invention, a radical generating agent (i.e., a compound generating free radicals when irradiated by light), which is used for photopolymerization compositions, or the like, can be added for the purpose of reducing yellow discoloring of background portions after recording. Examples of the radical generating agent include aromatic ketones, quinones, benzoin, benzoin ethers, azo compounds, organic disulfides, acyloxim esters, and the like. The addition amount of the radical generating agent is preferably from 0.01 to 5 parts by weight per part by weight of the diazonium salt compound.

Also, similarly, for the purpose of reducing yellow discoloring, a polymerizable compound having an ethylenically unsaturated bond (hereinafter, referred to as a vinyl monomer) can be used for the heat-sensitive recording material of the present invention. A vinyl monomer is a compound having at least one ethylenically unsaturated bond (a vinyl group, a vinylidene group, etc.) in the chemical structure thereof and has a monomer or a prepolymer chemical form. Examples thereof include unsaturated carboxylic acids or the salts thereof, the esters of unsaturated carboxylic acids and aliphatic polyhydric alcohols, the amides of unsaturated carboxylic acids and aliphatic polyhydric amines and the like. The vinyl monomer is used in an amount of from 0.2 to 20 parts by weight per part by weight of the diazonium salt compound.

The above-described radical generating agent and vinyl monomer can be used in the microcapsules together with the diazonium salt compound.

In the heat-sensitive recording materials of the present invention, in addition to the above-described materials, citric acid, tartaric acid, oxalic acid, boric acid, phosphoric acid, pyrophosphoric acid, or the like, can be added as an acid stabilizer.

For the heat-sensitive recording material of the present invention, a coating solution containing the diazonium salt compound-containing microcapsules, the coupling component, the organic base, and other additive(s) is prepared and coated onto a support such as paper, a synthetic resin film, or the like, by a coating method such as bar coating, blade coating, air-knife coating, gravure coating, roll coating, spray coating, dip coating, curtain coating, or the like, followed by drying, to form a heat-sensitive layer containing solid components of from 2.5 to 30 g/m$^2$.

In the heat-sensitive recording material of the present invention, the microcapsules, the coupling component, the organic base, and the like, may exist in the same layer, or a laminated layer-type structure wherein the above-described components exist in different layers may be employed. Also, after forming an intermediate layer on a support, the heat-sensitive layer or layers can be coated thereon as described in JP-A No. 61-54980.

As the binder used for the heat-sensitive recording material of the present invention, known water-soluble polymers, or latexes, or the like, can be used. Examples of water-soluble polymers used as a binder include methyl cellulose, carboxymethyl cellulose, hydroxyethyl cellulose, hydroxypropyl cellulose, starch derivatives, casein, gum arabic, gelatin, an ethylene-maleic anhydride copolymer, a styrene-maleic anhydride copolymer, polyvinyl alcohol, epichlorohydrin-modified polyamide, an isobutylene-maleic anhydride-salicylic acid copolymer, polyacrylic acid, polyacrylamide, and the like, and modified products thereof. Also, the latexes include a styrene-butadiene rubber latex, a methyl acrylate-butadiene rubber latex, a vinyl acetate emulsion, and the like.

As pigments which can be used for the heat-sensitive recording materials of the present invention, known pigments such as organic pigments and inorganic pigments can be used. Specific examples include kaolin, calcined kaolin, talc, agalmatolite, kieselguhr, calcium carbonate, aluminum hydroxide, magnesium hydroxide, zinc oxide, lithopone, amorphous silica, colloidal silica, calcined gypsum, silica, magnesium carbonate, titanium oxide, alumina, barium carbonate, barium sulfate, mica, microballoon, a urea-formalin filler, polyester particles, a cellulose filler, and the like.

In the heat-sensitive recording materials of the present invention, if necessary, various kinds of additives such as known waxes, antistatic agents, antifoaming agents, electrically conductive agents, fluorescent dyes, surface active agents, UV absorbers and the precursors thereof, and the like, can be used.

In the heat-sensitive recording material of the present invention, if necessary, a protective layer may be formed on the heat-sensitive recording layer. The protective layer may be, if necessary, a laminate of two or more layers. Examples of the material used for the protective layer include water-soluble polymer compounds such as polyvinyl alcohol, carboxy-modified polyvinyl alcohol, a vinyl acetate-acrylamide copolymer, silicon-modified polyvinyl alcohol, starch, denatured starch, methyl cellulose, carboxymethyl cellulose, hydroxymethyl cellulose, gelatins, gum arabic, casein, a styrene-maleic anhydride copolymer hydrolyzate, a styrene-maleic anhydride copolymer half ester hydrolyzate, an isobutylene-maleic anhydride copolymer hydrolyzate, polyacrylamide derivatives, polyvinyl pyrrolidone, sodium polystyrenesulfonate, sodium alginate, and the like; and latexes such as a styrene-butadiene rubber latex, an acrylonitrile-butadiene rubber latex, a methyl acrylate-butadiene rubber latex, a vinyl acetate emulsion, and the like. By crosslining the water-soluble polymer of the protective layer, the storage stability of the heat-sensitive recording material can be improved. As the crosslinking agent, a known crosslinking agent can be used. Specific examples of the crosslinking agent include water-soluble initial condensates such as N-methylolurea, N-methylolmelamine, urea-formalin, and the like; dialdehyde compounds such as glyoxal, glutaraldehyde, and the like; inorganic crosslinking agents such as boric acid, borax, and the like; polyamide epichlorohydrin; and the like. Furthermore, in the protective layer, known pigments, metallic soaps, waxes, surface active agents, and the like, can be used. The coating amount of the protective layer is preferably from 0.2 to 5 g/m$^2$, and more preferably from 0.5 to 2 g/m$^2$. Also, the thickness of the protective layer is preferably from 0.2 to 5 $\mu$m, and particularly preferably from 0.5 to 2 $\mu$m.

As the support used for the heat-sensitive recording material of the present invention, paper supports used for conventional pressure-sensitive paper, heat-sensitive paper, dry-type or wet-type diazo copy paper, or the like can be used. Specific examples include acid paper, neutralized paper, coated paper, plastic film-laminated paper obtained by laminating a plastic such as polyethylene, onto paper, synthetic paper, and plastic films of polyethylene terephthalate, polyethylene naphthalate, or the like. Also, in the heat-sensitive recording material of the present invention, to correct the curl balance of the support or to prevent the preparation of chemicals from the back surface of the support, a backcoat layer may be formed on the back surface of the support and the backcoat layer can be formed in the same manner as the above-described protective layer. Furthermore, it is possible to form a label by forming a releasing paper at the back surface of the support or back coat via an adhesive layer.

In the heat-sensitive recording material of the present invention, by laminating heat-sensitive recording layers each having a different developed hue, multicolor heat-sensitive recording material is obtained. Furthermore, an example of the heat-sensitive recording layers to be laminated is heat-sensitive recording layers each containing a photodecomposing diazonium salt compound. Such multicolor heat-sensitive recording materials (light-sensitive and heat-sensitive recording materials) are described in JP-A Nos. 4-135787, 4-144784, 4-144785, 4-194842, 4-247447, 4-247448, 4-340540, 4-340541, 5-34860, 9-156229, and the like. There is no particular restriction on the layer structure, but a multicolor heat-sensitive recording material having laminated layers of heat-sensitive recording layers each having a combination of the diazonium salt compound, each having a different light-sensitive wavelength, and the coupling component, each coloring in a different hue by thermally reacting with the diazonium salt compound, is particularly preferable. For example, the multicolor heat-sensitive recording material of the present invention has, from the support side, a first heat-sensitive recording layer (layer A) containing a diazonium salt compound of the present invention having a maximum absorption wavelength shorter than 350 nm and a coupling component undergoing color formation by thermally reacting with the diazonium salt compound; a second heat-sensitive recording layer (layer B) containing a diazonium salt compound having a maximum absorption wavelength of 360 nm±20 nm and a coupling component undergoing color formation by thermally reacting with the diazonium salt compound; and a third heat-sensitive recording layer (layer C) containing a diazonium salt compound having a maximum absorption wavelength of 400 nm±20 nm and a coupling component undergoing color formation by thermally reacting with the diazonium salt compound. In this example, by selecting the developed hues of the heat-sensitive recording layers such that the hues become three primary colors of the subtractive color process, i.e., yellow, magenta, and cyan, full color image recording becomes possible.

In the layer structure of the case of a full color recording. material, the coloring layers of yellow, magenta, and cyan may be laminated in any desired order, but from the viewpoint of color reproducibility, it is preferable to laminate the heat-sensitive recording layers in the order of yellow, cyan, and magenta or of yellow, magenta, and cyan from the support side.

In the recording method of the multicolor heat-sensitive recording material, first, the third heat-sensitive recording layer (layer C) is heated to color the diazonium salt compound and the coupling component contained in the layer by thermally reacting them. Then, after irradiating the recording material with light having a wavelength of 400±20 nm to decompose the unreacted diazonium salt compound contained in the layer C, sufficient heat for coloring the second heat-sensitive layer (layer B) is applied to color the diazonium salt compound and the coupling component contained in the layer by thermally reacting them. In this case, the layer C is also strongly heated, but because the diazonium salt compound in the layer C has already been decomposed and the coloring ability thereof has been lost, the diazonium salt compound is not colored. Furthermore, the recording material is irradiated by light having a wavelength of 360±20 nm to decompose the diazonium salt compound contained in the layer B, and finally sufficient heat for coloring the first heat-sensitive recording layer (layer A) is applied so as to color the diazonium salt compound and the coupling component contained in the layer. In this case, the heat-sensitive recording layers C and B are also strongly heated, but because the diazonium salt compounds in these layers have already been decomposed and the coloring abilities thereof have been lost, they do not color. It is preferable that the heat-sensitive recording material of the present invention is formed as the multicolor heat-sensitive recording material described above.

In the case of a multicolor heat-sensitive recording material, to prevent the occurrence of color mixing between the respective heat-sensitive recording layers each other, an interlayer may be formed between the recording layers. The interlayer is made up of a water-soluble polymer such as gelatin, phthalated gelatin, polyvinyl alcohol, polyvinyl pyrrolidone, or the like, and may contain various suitable additives.

In the case of a multicolor heat-sensitive recording material having a photofixing type heat-sensitive recording layer on the support, it is desirable to provide a photo-transmittance regulating layer and/or a protective layer on the upper layer. The photo-transmittance regulating layer is described in JP-A Nos. 9-39395, 9-39396, 9-95487, and the like.

In the present invention, the photo-transmittance regulating layer contains a component which functions as a precursor of a UV light absorber and does not function as a UV light absorber before the irradiation of light of a wavelength in the region required for fixing. Thereofore, the photo-transmittance regulating layer has a high photo-transmittance, sufficiently allows passage of light of a wavelength in the region necessary for fixing, and also has a high transmittance for visible rays, whereby it does not hinder the fixing of the heat-sensitive recording layers.

The precursor for the UV light absorber functions as the UV light absorber by reacting with light or heat after completion of the irradiation of the light of a wavelength necessary for fixing the photo-fixing type heat-sensitive recording layer by the irradiation of the light. The greater part of the light of wavelengths in the ultraviolet region is absorbed by the UV light absorber, the transmittance is lowered, and the light fastness of the heat-sensitive recording material is improved. However, because the UV light absorber does not have the effect of absorbing visible rays, the transmittance of visible rays is not substantially changed.

At least one photo-transmittance regulating layer can be formed in the photo-fixing type heat-sensitive recording material. It is most desirable to form the photo-transmittance regulating layer between the photo-fixing type heat-sensitive recording layer and the protective layer, but the photo-transmittance regulating layer may also function as the protective layer.

In the present invention, it is desirable that two photo-fixing type heat-sensitive recording layers each containing a diazonium salt compound, each of which has a different maximum absorption wavelength, and a coupling component, which undergoes color formation by reacting with the diazonium salt compound, are provided on the above-described heat-sensitive recording layers, and that the photo-transmittance regulating layer and the protective layer are successively formed on the photo-fixing type heat-sensitive recording layers.

EXAMPLES

The present invention will be further explained in detail below by the Examples, but the present invention is not limited thereby.

Example 1

(Preparation of diazonium salt compound-containing microcapsule solution A)

To 19 parts of ethyl acetate were added 2.8 parts of the diazonium salt compound (Compound 1-2) and 10 parts of tricresyl phosphate and they were uniformly mixed. Then, to the mixed solution was added 7.6 parts of Takenate D110N (manufactured by Takeda Chemical Industries, Ltd.) followed by mixing to obtain a solution I. Then, the above-described solution I was added to a mixed solution of 46 parts of an aqueous solution of 8% phthalated gelatin, 17.5 parts of water, and 2 parts of an aqueous solution of 10% sodium dodecylbenzenesulfonate, and the resultant mixture was emulsified and dispersed using a homogenizer for 10 minutes at 40° C. and 10,000 rpm. After adding 20 parts of water to the obtained emulsion and then uniformly mixing, a microencapsulation reaction was carried out while stirring for 3 hours at 40° C. to obtain a diazonium salt compound-containing microcapsule solution A. The mean particle size of the microcapsules was from 0.3 to 0.4 $\mu$m.

(Preparation of coupling component emulsion B)

In 10.5 parts of ethyl acetate were dissolved 3 parts of the coupling component (Compound C-70), 4 parts of triphenylguanidine, 8 parts of 2-ethylhexyl 4-hydroxybenzoate, 4 parts of 1,1-bis(4-hydroxyphenyl)-2-ethylhexane, 8 parts of 4,4'-(m-phenylenediisopropylidene) diphenol, 0.48 parts of tricresyl phosphate, and 0.24 parts of diethyl maleate to obtain a solution II.

Then, the solution II was added to a uniform mixture of 49 parts of an aqueous solution of 15% lime-processed gelatin, 9.5 parts of an aqueous solution of 10% sodium dodecylbenzenesulfonate, and 35 parts of water which had been uniformly mixed at 40° C., and the resultant mixture was emulsified and dispersed using a homogenizer for 10 minutes at 40° C. and 10,000 rpm. After stirring the obtained emulsion for 2 hours at 40° C., ethyl acetate was removed. And then, water was added to the emulsion to obtain a coupling component emulsion B.

(Preparation of heat-sensitive recording layer coating solution C)

By mixing 3.6 parts of the diazonium salt compound-containing microcapsule solution A, 3.3 parts of water, and 9.5 parts of the coupling component emulsion B, a heat-sensitive recording layer coating solution C was obtained.

(Preparation of protective layer coating solution D)

By uniformly mixing 32 parts of an aqueous solution of 10% polyvinyl alcohol (polymerization degree: 1,700, saponification degree: 88%) and 36 parts of water, a protective layer coating solution D was obtained.

(Coating)

After successively coating the heat-sensitive recording layer coating solution C and the protective layer coating solution D on a support for photographic paper obtained by laminating polyethylene on wood-free paper, the structure was dried at 50° C. to obtain the heat-sensitive recording material of Example 1. The coating amounts of the heat-sensitive recording layer and the protective layer as solid components were 8.0 g/m$^2$ and 1.2 g/m$^2$, respectively.

Examples 2 to 32

The heat-sensitive recording materials of Examples 2 to 32 were obtained by the same manner as that of Example 1 except that, instead of the diazonium salt compound (Compound 1-2) and the coupling component (Compound C-70), the diazonium salt compounds and the coupling components shown in Table 3 were used.

TABLE 3

| | Diazonium Salt Compound | Coupling Component |
|---|---|---|
| Example 1 | 1-2 | C-70 |
| Example 2 | 1-2 | C-71 |
| Example 3 | 1-2 | C-72 |
| Example 4 | 1-9 | C-70 |
| Example 5 | 1-9 | C-73 |
| Example 6 | 1-9 | C-74 |
| Example 7 | 1-9 | C-75 |
| Example 8 | 1-9 | C-76 |
| Example 9 | 1-9 | C-52 |
| Example 10 | 1-10 | C-70 |
| Example 11 | 1-10 | C-78 |
| Example 12 | 1-15 | C-79 |
| Example 13 | 1-15 | C-80 |
| Example 14 | 5-2 | C-42 |
| Example 15 | 5-2 | C-9 |
| Example 16 | 5-3 | C-70 |
| Example 17 | 1-9 | D-2 |
| Example 18 | 1-9 | D-3 |
| Example 19 | 1-9 | D-4 |
| Example 20 | 1-9 | D-9 |
| Example 21 | 1-9 | D-15 |
| Example 22 | 1-9 | D-43 |
| Example 23 | 1-10 | D-7 |
| Example 24 | 1-10 | D-9 |
| Example 25 | 1-11 | D-8 |
| Example 26 | 1-11 | D-15 |
| Example 27 | 1-15 | D-11 |
| Example 28 | 1-15 | D-21 |
| Example 29 | 5-3 | D-9 |
| Example 30 | 5-3 | D-24 |
| Example 31 | 5-5 | D-29 |
| Example 32 | 5-5 | D-22 |

Comparative Examples 1 to 7

The heat-sensitive recording materials of Comparative Examples 1 to 7 were obtained in the same manner as that of Example 1 except that, instead of the diazonium salt compound (Compound 1-2) and the coupling component (Compound C-70), the diazonium salt compounds and the coupling components shown in Table 4 were used. The diazonium salt compounds (B-1), (B-2) represented by formulae other than formula (1) and the coupling components (E), (F) represented by formulae other than formulae (2) and (3) are shown below.

TABLE 4

| | Diazonium Salt Compound | Coupling Component |
|---|---|---|
| Comparative Example 1 | B-1 | C-70 |
| Comparative Example 2 | B-2 | C-74 |
| Comparative Example 3 | B-1 | D-8 |
| Comparative Example 4 | B-2 | D-9 |
| Comparative Example 5 | 1-9 | E |
| Comparative Example 6 | 1-10 | F |
| Comparative Example 7 | B-1 | F |

B-1

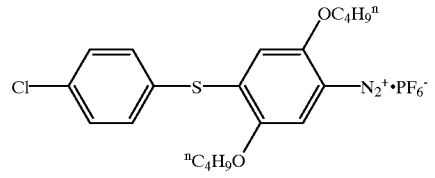

-continued

B-2

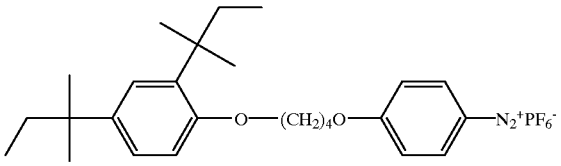

E

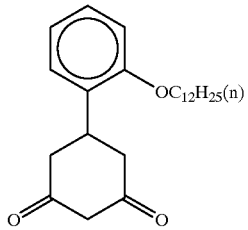

F

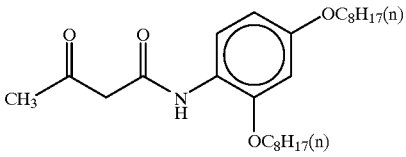

Evaluation

Evaluations of the heat-sensitive recording materials of Examples 1 to 32 and Comparative Examples 1 to 7 were carried out. Results are shown in Table 5.

(Coloring test)

A thermal head (Type KST, manufactured by Kyocera Corporation) was used to perform thermal printing on the heat-sensitive recording material to obtain images after setting the power to be applied and the pulse width for the thermal head such that the recording energy per unit area became 50 mJ/mm$^2$. Thereafter, the entire surface of the formed image was irradiated with ultraviolet light for 10 seconds using a ultraviolet lamp having a light emitting central wavelength of 420 nm and an output power of 40 W. The density of colored portion and the background density were measured. For a colored portion, a density of 1.2 or more is a density in a usable range, and for a background portion, a density of 0.1 or lower is a density in a usable range.

(Light fastness test)

After irradiating the recorded heat-sensitive recording material at 30,000 lux for 72 hours using a machine for testing fastness equipped with a fluorescent light, the densities of the colored portion and the background portion were measured. The smaller the reduction in density of the colored portion is and the smaller the increase in density of the background portion is after irradiation by the fluorescent lamp, the better the light fastness is.

(Evaluation of storability before use)

The heat-sensitive recording material before recording was stored for 72 hours under the conditions of 40° C. and 90% RH. After storage, the above-described color formation test was applied, and the densities of the colored portion and the background portion were measured. The smaller the reduction in density of the colored portion is and the smaller the increase in density of the background portion is after storage, the better the storage before use (shelf life) is.

(Light stability test)

The entire surface of the heat-sensitive recording material before recording was irradiated with ultraviolet light for 10 seconds using an ultraviolet lamp having a light-emitting central wavelength of 365 nm and an output power of 40 W. The sample was thermally printed in the same way as in the above-described coloring test to obtain images, and the density of the image was measured. The smaller the reduction in density of the image after the irradiation by the ultraviolet lamp is, the better the light stability of the sample is.

(Density measurement)

The densities of the colored portion and the background portion at the Y position were measured by using a Macbeth reflection densitometer RD 918 at the Y position.

TABLE 5

| | Density of color formation | Density of colored portion after light fastness test | Density of colored portion after storability test | Density of background portion | Density of background portion after light fastness test | Density of background portion after storability test | Density of color formation after light stability test |
|---|---|---|---|---|---|---|---|
| Example 1 | 1.25 | 1.20 | 1.16 | 0.07 | 0.10 | 0.09 | 1.25 |
| Example 2 | 1.24 | 1.20 | 1.14 | 0.07 | 0.10 | 0.09 | 1.24 |
| Example 3 | 1.26 | 1.21 | 1.16 | 0.07 | 0.10 | 0.09 | 1.26 |
| Example 4 | 1.30 | 1.25 | 1.20 | 0.07 | 0.10 | 0.09 | 1.30 |
| Example 5 | 1.27 | 1.22 | 1.16 | 0.07 | 0.10 | 0.09 | 1.27 |
| Example 6 | 1.28 | 1.23 | 1.18 | 0.07 | 0.09 | 0.09 | 1.28 |
| Example 7 | 1.29 | 1.24 | 1.20 | 0.07 | 0.10 | 0.09 | 1.29 |
| Example 8 | 1.30 | 1.25 | 1.19 | 0.07 | 0.10 | 0.08 | 1.30 |
| Example 9 | 1.28 | 1.22 | 1.23 | 0.07 | 0.09 | 0.09 | 1.28 |
| Example 10 | 1.26 | 1.21 | 1.17 | 0.07 | 0.09 | 0.09 | 1.26 |
| Example 11 | 1.27 | 1.22 | 1.17 | 0.07 | 0.10 | 0.08 | 1.27 |
| Example 12 | 1.28 | 1.23 | 1.19 | 0.07 | 0.10 | 0.09 | 1.28 |
| Example 13 | 1.31 | 1.26 | 1.21 | 0.07 | 0.09 | 0.09 | 1.31 |
| Example 14 | 1.30 | 1.21 | 1.20 | 0.07 | 0.10 | 0.09 | 1.30 |
| Example 15 | 1.27 | 1.19 | 1.17 | 0.07 | 0.10 | 0.10 | 1.27 |
| Example 16 | 1.26 | 1.21 | 1.16 | 0.07 | 0.10 | 0.10 | 1.26 |
| Example 17 | 1.30 | 1.21 | 1.20 | 0.07 | 0.08 | 0.09 | 1.30 |
| Example 18 | 1.28 | 1.19 | 1.18 | 0.07 | 0.08 | 0.09 | 1.28 |
| Example 19 | 1.29 | 1.20 | 1.19 | 0.07 | 0.08 | 0.09 | 1.29 |
| Example 20 | 1.33 | 1.31 | 1.22 | 0.07 | 0.08 | 0.09 | 1.33 |
| Example 21 | 1.32 | 1.30 | 1.21 | 0.07 | 0.08 | 0.09 | 1.32 |

TABLE 5-continued

| | Density of color formation | Density of colored portion after light fastness test | Density of colored portion after storability test | Density of background portion | Density of background portion after light fastness test | Density of background portion after storability test | Density of color formation after light stability test |
|---|---|---|---|---|---|---|---|
| Example 22 | 1.30 | 1.21 | 1.19 | 0.07 | 0.10 | 0.09 | 1.30 |
| Example 23 | 1.33 | 1.31 | 1.22 | 0.07 | 0.08 | 0.09 | 1.33 |
| Example 24 | 1.32 | 1.30 | 1.21 | 0.07 | 0.08 | 0.09 | 1.32 |
| Example 25 | 1.32 | 1.29 | 1.21 | 0.07 | 0.08 | 0.09 | 1.32 |
| Example 26 | 1.31 | 1.26 | 1.20 | 0.07 | 0.09 | 0.09 | 1.31 |
| Example 27 | 1.28 | 1.24 | 1.19 | 0.07 | 0.08 | 0.09 | 1.28 |
| Example 28 | 1.29 | 1.24 | 1.19 | 0.07 | 0.09 | 0.10 | 1.29 |
| Example 29 | 1.30 | 1.26 | 1.20 | 0.07 | 0.08 | 0.09 | 1.30 |
| Example 30 | 1.27 | 1.17 | 1.18 | 0.07 | 0.08 | 0.09 | 1.27 |
| Example 31 | 1.26 | 1.19 | 1.16 | 0.07 | 0.09 | 0.09 | 1.26 |
| Example 32 | 1.27 | 1.22 | 1.17 | 0.07 | 0.09 | 0.09 | 1.27 |
| Comparative Example 1 | 0.82 | 0.50 | 0.62 | 0.08 | 0.15 | 0.11 | 0.08 |
| Comparative Example 2 | 1.02 | 0.87 | 0.79 | 0.07 | 0.10 | 0.10 | 1.02 |
| Comparative Example 3 | 0.96 | 0.76 | 0.77 | 0.08 | 0.15 | 0.11 | 0.08 |
| Comparative Example 4 | 0.97 | 0.85 | 0.76 | 0.07 | 0.10 | 0.10 | 0.97 |
| Comparative Example 5 | 1.10 | 0.42 | 0.98 | 0.07 | 0.10 | 0.09 | 1.10 |
| Comparative Example 6 | 1.00 | 0.51 | 0.85 | 0.07 | 0.10 | 0.10 | 1.00 |
| Comparative Example 7 | 1.23 | 0.48 | 1.03 | 0.08 | 0.14 | 0.11 | 0.08 |

From Table 5, it can be seen that the heat-sensitive recording materials of Examples 1 to 32 are stable with respect to light having longer wavelengths from about 350 nm, provide a high density of color formation of colored portions, and have excellent light fastness and storability. On the other hand, the conventional heat-sensitive materials of Comparative Examples 1 to 7, in which at least one of the diazonium salt compound and the coupling component is known, provide a low density of color formation of colored portions, and in particular, are inferior with respect to light fastness and storability compared to the heat-sensitive recording materials of Examples 1 to 32.

What is claimed is:

1. A heat-sensitive recording material comprising a support and a heat-sensitive recording layer thereon, which contains a diazonium salt compound and a coupling component, wherein the diazonium salt compound contains a benzenediazonium salt compound represented by formula (1), and the coupling component contains a uracil compound represented by the formula (2), Formula (1)

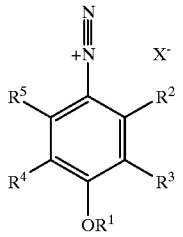

wherein $R^1$ represents a substituted or unsubstituted alkyl group or a substituted or unsubstituted aryl group; $R^2$, $R^3$, $R^4$ and $R^5$ each independently represents a hydrogen atom or a substituted or unsubstituted alkyl group, and at least one of $R^2$, $R^3$, $R^4$ and $R^5$ represents a substituted or unsubstituted alkyl group; $X^-$ represents an anion; and $R^1$ and $R^3$, $R^1$ and $R^4$, $R^2$ and $R^3$, and $R^4$ and $R^5$ may bind to form a ring, Formula (2)

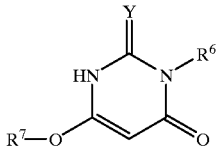

wherein $R^6$ represents a hydrogen atom, an unsubstituted alkyl group, an alkyl group substituted by a halogen atom, —$L^1$—A, an unsubstituted aryl group, an aryl group substituted by a halogen atom, an aryl group substituted by an alkyl group, an aryl group substituted by an alkoxycarbonyl group, an aryl group substituted by a N-substituted carbamoyl group, a substituted or unsubstituted acyl group, a substituted or unsubstituted alkylsulfonyl group, or a substituted or unsubstituted arylsulfonyl group, wherein $L^1$ represents an alkylene group, and A represents a substituted or unsubstituted aryl group, a substituted or unsubstituted alkoxycarbonyl group, or a N-substituted carbamoyl group; $R^7$ represents a substituted or unsubstituted alkyl group, a substituted or unsubstituted aryl group, a substituted or unsubstituted alkenyl group, or a substituted or unsubstituted alkynyl group; and Y represents an oxygen atom or a sulfur atom.

2. A heat-sensitive recording material comprising a support and a heat-sensitive recording layer thereon, which contains a diazonium salt compound and a coupling component, wherein the diazonium salt compound contains a benzenediazonium salt compound represented by formula (1), and the coupling component contains a barbituric acid compound represented by the formula (3), Formula (1)

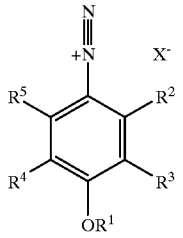

wherein $R^1$ represents a substituted or unsubstituted alkyl group or a substituted or unsubstituted aryl group; $R^2$, $R^3$, $R^4$ and $R^5$ each independently represents a hydrogen atom or a substituted or unsubstituted alkyl group, and at least one of $R^2$, $R^3$, $R^4$ and $R^5$ represents a substituted or unsubstituted alkyl group; $X^-$ represents an anion; and $R^1$ and $R^3$, $R^1$ and $R^4$, $R^2$ and $R^3$, and $R^4$ and $R^5$ may bind to form a ring, Formula (3)

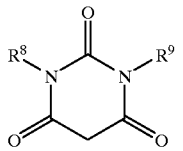

wherein $R^8$ and $R^9$ each independently represent a hydrogen atom, an unsubstituted alkyl group, an alkyl group substituted by a N-substitute carbamoyl group, —$L^2$—COO—$M^1$—$B^1$, —$L^3$—COO—$M^2$—$B^2$, a substituted or unsubstituted aryl group, a substituted or unsubstituted acyl group, a substituted or unsubstituted alkylsulfonyl group, or a substituted or unsubstituted arylsulfonyl group, wherein $L^2$, $L^3$, $M^1$ and $M^2$ each independently represents an alkylene group, and $B^1$ and $B^2$ each independently represents a substituted or unsubstituted aryloxy group or a substituted or unsubstituted arylthio group.

3. A heat-sensitive recording material according to claim 1, wherein the diazonium salt compound is encapsulated in microcapsules.

4. A heat-sensitive recording material according to claim 2, wherein the diazonium salt compound is encapsulated in microcapsules.

5. A heat-sensitive recording material according to claim 1, wherein said benzenediazonium salt compound is represented by formula (4), Formula (4)

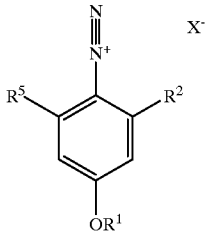

wherein $R^1$ represents a substituted or unsubstituted alkyl group or a substituted or unsubstituted aryl group; $R^2$ and $R^5$ each independently represents a hydrogen atom or a substituted or unsubstituted alkyl group, and at least one of $R^2$ and $R^5$ represents a substituted or unsubstituted alkyl group; and $X^-$ represents an anion.

6. A heat-sensitive recording material according to claim 2, wherein said benzenediazonium salt compound is represented by formula (4), Formula (4)

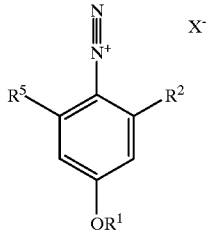

wherein $R^1$ represents a substituted or unsubstituted alkyl group or a substituted or unsubstituted aryl group; $R^2$ and $R^5$ each independently represents a hydrogen atom or a substituted or unsubstituted alkyl group, and at least one of $R^2$ and $R^5$ represents a substituted or unsubstituted alkyl group; and $X^-$ represents an anion.

7. A heat-sensitive recording material according to claim 1, wherein said uracil compound is represented by formula (5), Formula (5)

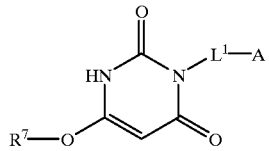

wherein $R^7$ is the same as defined in claim 1; $L^1$ represents an alkylene group; and A represents an aryl group, an alkoxycarbonyl group, or an N-substituted carbamoyl group.

8. A heat-sensitive recording material according to claim 2, wherein said barbituric acid compound is represented by formula (6), Formula (6)

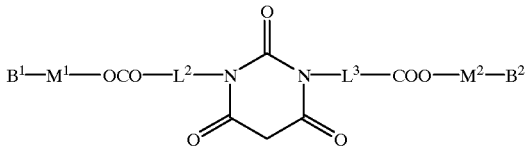

wherein $L^2$, $L^3$, $M^1$ and $M^2$ each independently represents an alkylene group; and $B^1$ and $B^2$ each independently represents an aryloxy group or an arylthio group.

9. A heat-sensitive recording material according to claim 5, wherein said uracil compound is represented by formula (5), Formula (5)

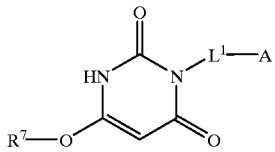

wherein $R^7$ is the same as defined in claim 1; $L^1$ represents an alkylene group; and A represents an aryl group, an alkoxycarbonyl group, or an N-substituted carbamoyl group.

10. A heat-sensitive recording material according to claim 6, wherein said barbituric acid compound is represented by formula (6), Formula (6)

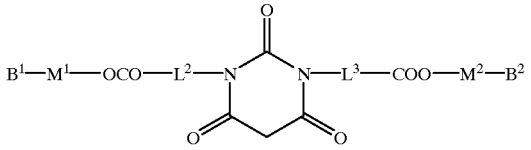

wherein $L^2$, $L^3$, $M^1$ and $M^2$ each independently represents an alkylene group; and $B^1$ and $B^2$ each independently represents an aryloxy group or an arylthio group.

11. A heat-sensitive recording material according to claim 1, wherein said anion represented by $X^-$ is an inorganic anion selected from the group consisting of a hexafluorophosphate ion, a borofluoride ion, a chloride ion and a sulfate ion; or an organic anion selected from the group consisting of a polyfluoroalkylcarboxylate ion, a polyfluoroalkylsulfonate ion, a tetraphenylborate ion, an aromatic carboxylate ion and an aromatic sulfonate ion.

12. A heat-sensitive recording material according to claim 2, wherein said anion represented by $X^-$ is an inorganic anion selected from the group consisting of a hexafluorophosphate ion, a borofluoride ion, a chloride ion and a sulfate ion; or an organic anion selected from the group consisting of a polyfluoroalkylcarboxylate ion, a polyfluoroalkylsulfonate ion, a tetraphenylborate ion, an aromatic carboxylate ion and an aromatic sulfonate ion.

13. A heat-sensitive recording material according to claim 3, wherein walls of said microcapsules are comprised of a polymer having a glass transition temperature in a range of from 60 to 200° C.

14. A heat-sensitive recording material according to claim 4, wherein walls of said microcapsules are comprised of a polymer having a glass transition temperature in a range of from 60 to 200° C.

15. A heat-sensitive recording material according to claim 1, comprising a plural of said heat-sensitive recording layers each having a different developed hue, wherein the heat-sensitive recording material is a multicolor heat-sensitive recording material.

16. A heat-sensitive recording material according to claim 2, comprising a plural of said heat-sensitive recording layers each having a different developed hue, wherein the heat-sensitive recording material is a multicolor heat-sensitive recording material.

17. A heat-sensitive recording material according to claim 15, wherein the diazonium salt compound is encapsulated in microcapsules.

18. A heat-sensitive recording material according to claim 16, wherein the diazonium salt compound is encapsulated in microcapsules.

19. A heat-sensitive recording material according to claim 15, wherein the multicolor heat-sensitive recording material has a photofixing type heat-sensitive recording layer, and a photo-transmittance regulating layer and/or a protective layer are placed above the photofixing type heat-sensitive recording layer.

20. A heat-sensitive recording material according to claim 16, wherein the multicolor heat-sensitive recording material has a photofixing type heat-sensitive recording layer, and a photo-transmittance regulating layer and/or a protective layer are placed above the photofixing type heat-sensitive recording layer.

* * * * *